US008155345B2

(12) United States Patent
Tagawa et al.

(10) Patent No.: US 8,155,345 B2
(45) Date of Patent: Apr. 10, 2012

(54) WEARABLE TERMINAL, MOBILE IMAGING SOUND COLLECTING DEVICE, AND DEVICE, METHOD, AND PROGRAM FOR IMPLEMENTING THEM

(75) Inventors: Junichi Tagawa, Kyoto (JP); Takeo Kanamori, Osaka (JP)

(73) Assignee: Panasonic Corporation, Osaka (JP)

( * ) Notice: Subject to any disclaimer, the term of this patent is extended or adjusted under 35 U.S.C. 154(b) by 784 days.

(21) Appl. No.: 12/280,842

(22) PCT Filed: Feb. 27, 2007

(86) PCT No.: PCT/JP2007/053518

§ 371 (c)(1), (2), (4) Date: Dec. 16, 2008

(87) PCT Pub. No.: WO2007/099908

PCT Pub. Date: Sep. 7, 2007

(65) Prior Publication Data

US 2009/0129620 A1 May 21, 2009

(30) Foreign Application Priority Data

Feb. 27, 2006 (JP) ..... 2006-051029

(51) Int. Cl.

| | |
|---|---|
| ***H04R 3/00*** | (2006.01) |
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl. ..... 381/92; 381/122; 381/364

(58) Field of Classification Search ..... 381/92, 381/122, 364

See application file for complete search history.

(56) References Cited

U.S. PATENT DOCUMENTS

| | | | | |
|---|---|---|---|---|
| 6,516,066 | B2 * | 2/2003 | Hayashi | 381/92 |
| 7,283,850 | B2 * | 10/2007 | Granovetter et al. | 455/570 |
| 7,536,020 | B2 * | 5/2009 | Fukumoto et al. | 381/151 |
| 2004/0136541 | A1 * | 7/2004 | Hamacher et al. | 381/60 |
| 2005/0259832 | A1 * | 11/2005 | Nakano | 381/92 |

(Continued)

FOREIGN PATENT DOCUMENTS

| | | |
|---|---|---|
| JP | 59-40798 | 3/1984 |

(Continued)

OTHER PUBLICATIONS

International Search Report issued May 29, 2007 in the International (PCT) Application of which the present application is the U.S. National Stage.

(Continued)

*Primary Examiner* — Victor A Mandala

(74) *Attorney, Agent, or Firm* — Wenderoth, Lind & Ponack, L.L.P.

(57) ABSTRACT

A wearable terminal is constantly worn by a user and continually picks up images and sounds from the surroundings. Even when using a directional microphone to sensitively pick up targeted audio, the wearable terminal can reduce noise occurring due to motion of the device, for example when the user is walking, and reduce the influence of a shift of the sound pickup direction. For this purpose, the wearable terminal includes a sensor for detecting motion, and performs microphone directivity control to use the directional microphone when the amount of motion is small, and to use an omnidirectional microphone that is not likely to be influenced by noise when the amount of motion is large.

20 Claims, 17 Drawing Sheets

U.S. PATENT DOCUMENTS

| | | | | |
|---|---|---|---|---|
| 2005/0286728 | A1* | 12/2005 | Grosvenor et al. | 381/91 |
| 2006/0088176 | A1* | 4/2006 | Werner, Jr. | 381/113 |
| 2006/0115103 | A1* | 6/2006 | Feng et al. | 381/313 |

FOREIGN PATENT DOCUMENTS

| | | |
|---|---|---|
| JP | 63-59300 | 3/1988 |
| JP | 64-39193 | 2/1989 |
| JP | 1-197000 | 8/1989 |
| JP | 4-259171 | 9/1992 |
| JP | 10-155107 | 6/1998 |
| JP | 11-18190 | 1/1999 |
| JP | 11-341592 | 12/1999 |
| JP | 2002-218583 | 8/2002 |
| JP | 2002-344787 | 11/2002 |
| JP | 2005-37273 | 2/2005 |
| JP | 2005-176138 | 6/2005 |
| JP | 2005-333211 | 12/2005 |

OTHER PUBLICATIONS

Japanese Office Action issued Sep. 13, 2011 in corresponding Japanese Patent Application No. 2008-502773.

* cited by examiner

DIRECTIVITY CHARACTERISTIC OF UNIDIRECTIONAL MICROPHONE

DIRECTIVITY CHARACTERISTIC OF OMNIDIRECTIONAL MICROPHONE

WEARABLE TERMINAL, MOBILE IMAGING SOUND COLLECTING DEVICE, AND DEVICE, METHOD, AND PROGRAM FOR IMPLEMENTING THEM

TECHNICAL FIELD

The present invention relates to improving audio quality of sound pickup by a microphone in a wearable terminal.

BACKGROUND ART

In recent years, a wearable terminal has been developed that is worn constantly by a user, enabling recording everyday life experiences of the user as a lifelog. Here, the wearable terminal refers to a compact terminal that can be worn on the body of the user. The present invention focuses on a terminal that includes video and audio recording functions so that the wearable terminal can store audio and video. The wearable terminal continues the recording function even without any explicit operation, namely an operation performed by a hand or a finger, being performed. Also, the wearable terminal includes an attachment unit, and is a portable terminal or portable audio/video recording device that can be affixed to clothing or, by attaching a strap to the attachment unit, supported at a predetermined reference position of the body, e.g. hanging from the neck. When the sound pickup direction of a microphone attached to this type of wearable terminal faces a front direction faced by a camera, the microphone can pick up a voice, etc., of a person talking to the user face-to-face, and when the sound pickup direction faces upward, the microphone can pick up the voice, etc. of the user. Since wearable terminals used for this purpose are required to record sound clearly even in a noisy outdoor environment, a directional microphone such as a unidirectional microphone is used to sensitively pick up acoustic signals from a specified direction.

Patent document 1: Japanese Patent Application Publication No. H01-39193

Patent document 2: Japanese Patent Application Publication No. 2005-37273

However, though the sensitivity of a unidirectional microphone is high in a specified direction, the sensitivity is low in other directions. Therefore, there is a problem when the sound pickup direction changes due to motion, e.g. when a user wearing the wearable terminal is walking. FIGS. 1A and 1B show directivity characteristic patterns pertaining to sensitivity of a unidirectional microphone and an omnidirectional microphone. FIGS. 1A and 1B show that although the omnidirectional microphone picks up sound from all directions with equal sensitivity, the unidirectional microphone picks up sound sensitively from the front direction while sound from other directions is suppressed. Accordingly, for example, when the wearable terminal is hanging from the neck by a strap, and the microphone is facing front to pick up the voice of a person to whom the user is talking, if a movement of the user causes the neck strap to twist and the wearable terminal to rotate 90° to the right of the front direction, sound is suppressed from the front direction that was originally intended to be the sound pickup direction, and sound from the direction 90° to the right, which was originally intended to be suppressed, is picked up with high sensitivity.

Also, the unidirectional microphone is vulnerable to noise. FIG. 2 shows frequency characteristics pertaining to sensitivity of the unidirectional microphone and the omnidirectional microphone. The unidirectional microphone is realized by synthesis of two omnidirectional microphones, which are arranged at a distance d apart from each other. A phase difference is given to the signal picked up by one of the omnidirectional microphones, and the output of one of the omnidirectional microphones is subtracted from the output of the other omnidirectional microphone. This synthesis method is called a sound pressure gradient-type directivity synthesis method. FIG. 2 compares the sensitivity of the omnidirectional microphones before the synthesis and the unidirectional microphone after the synthesis. In the high frequency area, both the unidirectional microphone and the omnidirectional microphones demonstrate a favorable sensitivity even in the presence of noise. However, while the sensitivity of the omnidirectional microphones is only slightly dependent on frequency, the sensitivity of the unidirectional microphone significantly decreases at low frequencies. In particular, as d, which is the parameter representing the size of the unidirectional microphone, becomes smaller, low-frequency sensitivity decreases. Since a portable device such as the wearable terminal is required to have a small size, overcoming the sensitivity problem by arranging the microphones farther apart is difficult. The signal to noise ratio of the unidirectional microphone becomes smaller at lower frequencies. Since noise generated by the movement of the user has a low frequency of several Hz, when the sensitivity of the unidirectional microphone is corrected by amplifying the low frequency area with use of an equalizer, the low-frequency noise component is relatively emphasized.

Patent document 1 discloses conventional technology pertaining to noise resistance measures in a unidirectional microphone. Patent document 1 discloses a device that switches between a unidirectional microphone and an omnidirectional microphone in accordance with a result of detecting wind noise in an acoustic signal picked up by a microphone occurring when wind hits the microphone. However, though the device of patent document 1 has a structure suited for achieving the aim of suppressing wind noise in a unidirectional microphone, sensing noise that occurs suddenly due to motion of the device and switching appropriately between output signals of two microphones is difficult.

Since the wearable terminal is worn constantly and sound pickup continues independently of the status of the user, there is a constant risk of the movements of the user causing the movable terminal to be moved or to collide with the body of the user. When using a unidirectional microphone, motion-related noise and the influence of a shift of the sound pickup direction significantly reduce sound pickup quality. Therefore, measures to counter such effects are necessary.

An aim of the present invention is to provide a device, such as a wearable terminal, that continuously performs sound pickup in an unstable environment and can prevent a reduction in sound quality as much as possible even when the device is in motion.

SUMMARY OF THE INVENTION

To achieve the above aim, the wearable terminal pertaining to the present invention is a wearable terminal including: a sound pickup unit operable to form a directivity having a predetermined pattern, and to pick up sound in accordance with the formed directivity; a detection unit operable to detect motion of a wearable terminal housing; and a switching unit operable to, in accordance with an amount of detected motion, switch from a directivity currently used for sound pickup to a different directivity. The different directivity is one of a directivity having a different pattern from the directivity being used directly before the switch, and omnidirectionality.

The wearable terminal of the present invention enables switching from a directivity currently used for sound pickup to a different directivity by detecting whether the device is in a stable state having a small amount of motion, or an unstable state having a large amount of motion. The different directivity is one of a directivity having a different pattern from the directivity being used directly before the switch, and omnidirectionality. When the device is in the stable state, targeted audio can be sensitively picked up by giving directivity to a microphone. When the device is in the unstable state, input from an omnidirectional microphone is used so that the motion has less of an influence on the sound pickup.

Here, "motion" indicates not only the continuous changing of the location of the wearable terminal, e.g. in a forward/backward or up/down direction, but also a vector in which the terminal location is displaced in an arbitrary direction. The amount of motion is a scalar quantity expressed as an absolute value of the vector. The absolute value of the vector indicates, by being 0 or other than 0, whether motion exists. A component value in a predetermined direction of the vector indicates the amount of motion in the predetermined direction.

Switching from a directivity currently used for sound pickup to a different directivity in accordance with the amount of motion enables picking up targeted audio clearly by reducing the influence of motion caused by movement of the user, even when the device is constantly worn and sound pickup is continuous, as in the wearable terminal.

When motion causes the neck strap to twist and the sound pickup direction shifts, if the amount of motion is small, the audio originally intended to be picked up is picked up sensitively by the directional microphone. If the amount of motion is large and causes the neck strap to twist and the sound pickup direction shifts 90°, switching to an omnidirectional microphone prevents a reduction in sensitivity to the audio that was originally intended to be picked up.

Also, since even if low-frequency noise is generated by movement of the user, if the directional microphone is switched to the omnidirectional microphone, the sensitivity ceases to be dependent on frequency, thereby eliminating the need for the equalizer to amplify the low-frequency area, and preventing a situation in which a low-frequency noise component is relatively emphasized.

Here, the sound pickup unit may include a plurality of microphones, and the motion used as a reference for the switch by the switching unit may be motion that occurs in a reference axis direction of one of the microphones.

Since motion that causes a large amount of displacement of the microphone in the reference axis direction is the most likely to generate noise, switching directivity can be effectively performed by judging how much motion occurs in the reference axis direction of the microphone.

Here, each of the microphones may include a diaphragm that senses sound pressure, the reference axis direction may be an axial direction of the diaphragm when the diaphragm is considered to be substantially axially symmetric, and the motion detected by the detection unit may be motion in a pitch direction.

The diaphragm of the microphone is normally shaped to have substantially axial symmetry, and if the axis of symmetry is considered to be the reference axis, the reference axis direction is called the pitch direction. Since motion in the pitch direction has the largest influence on noise, targeting such motion for detection enables performing effective noise resistance measures.

Here, the detection unit may include a sensor operable to output angular velocities of motion occurring in each of a pitch direction, a roll direction, and a yaw direction of the wearable terminal housing, and a converting subunit operable to select from among the angular velocities of motion occurring in the pitch direction, the roll direction, and the yaw direction, and convert an angular velocity of motion that causes the one of the microphones to be displaced in the reference axis direction into a displacement amount, and the switching unit may include a comparison subunit operable to compare the displacement amount to a threshold, and the switch by the switching unit may be performed if the displacement amount exceeds the threshold.

Detecting the amount of motion of the device with use of the angular velocities and comparing the amount of motion to the threshold enables judging whether to give the microphone directivity. If the motion exceeds the threshold, switching to the omnidirectional microphone enables reducing the influence of motion-related noise.

Here, if the displacement amount exceeds the threshold, the directivity that the sound pickup unit uses to pick up sound may be switched to be omnidirectional by the switching unit.

When the displacement amount expressing the amount of motion of the device exceeds the threshold, switching the directivity of the sound pickup unit to omnidirectional enables reducing the influence of motion-related noise. Determining the threshold during the design phase enables controlling resistance to the motion.

Here, the wearable terminal may further include a camera. If the displacement amount is less than or equal to the threshold, the directivity that the sound pickup unit uses to pick up sound may be switched to be an image pickup direction of the camera by the switching unit.

If the displacement amount expressing the amount of motion of the device does not exceed the threshold, a judgment is made that even with use of the directional microphone, the influence of noise is small. Aligning the directivity of the sound pickup unit with the image pickup direction of the camera enables picking up clearer audio from the subject of the image pickup.

Here, the wearable terminal may further include: a camera operable to perform image processing at predetermined time intervals, wherein the detection by the detection unit may be performed by comparing a first image taken by the camera and a second image taken by the camera at a previous time to the first image, and the motion detected by the detection unit may be motion in the reference axis direction.

A wearable terminal including a camera for recording video at the same time as audio can judge an amount of motion with use of images taken with the camera, even if a separate sensor is not installed. Analyzing the video enables judging whether the motion is in the reference axis direction of the microphone.

Here, in accordance with the first image and the second image, if the displacement amount of the wearable terminal housing in the pitch direction is judged to exceed a threshold, the directivity that the sound pickup unit uses to pick up sound may be switched to be omnidirectional by the switching unit.

Analyzing images taken with a camera enables judging the direction of motion of the device, thus enabling detecting motion in the pitch direction, which is most likely to cause noise. Switching the directivity to omnidirectional if the displacement amount indicating the amount of motion in the pitch direction exceeds the threshold enables reducing the influence of noise.

Here, if the displacement amount in the reference axis direction is output that has impulsivity, the directivity that the sound pickup unit uses to pick up sound may be switched to be omnidirectional by the switching unit.

Detecting motion that has impulsivity (impulsive motion) occurring when the wearable terminal collides with the body, etc. and switching to the omnidirectional microphone if such motion is detected enables reducing the effects of sudden noise.

Here, the detection unit may include a sensor that outputs angular velocities of motion occurring in each of a pitch direction, a roll direction, and a yaw direction of the wearable terminal housing, the output that has impulsivity may be expressed by a difference value between respective displacement amounts obtained from the angular velocities of motion occurring in two or more of the pitch direction, the roll direction, and the yaw direction, the switching unit may include a comparison subunit that compares the difference value to a threshold, and the switch by the switching unit may be performed if the difference value exceeds the threshold.

Detecting the amount of motion of the device with use of an angular velocity, considering the difference value indicating the amount of change in the motion as an amount of impulsive motion, and switching from the directional microphone to the omnidirectional microphone if the difference value exceeds a threshold enables reducing the effects of sudden noise.

Here, the wearable terminal may further include: a camera operable to perform image processing at predetermined time intervals, wherein the output that has impulsivity may be expressed by an amount of shake in images taken by the camera.

If shake occurs in images taken with a camera, considering the shake to indicate impulsive motion, and switching to an omnidirectional microphone in such a case enables reducing the effects of sudden noise.

Here, the sound pickup unit may include at least one each of a directional microphone and an omnidirectional microphone. If motion is detected by the detection unit, the switch by the switching unit may be performed by switching from outputting a signal received from the directional microphone to outputting a signal received from the omnidirectional microphone.

Separately providing a directional microphone and an omnidirectional microphone enables switching between the directional microphone and the omnidirectional microphone in accordance with the amount of motion. Using the directional microphone that sensitively picks up targeted audio when there is a small amount of motion, and using the omnidirectional microphone, which is highly resistant to noise and has a predetermined amount of sensitivity regardless of the pickup direction, when there is a large amount of motion enables preventing a reduction in sound quality even when performing sound pickup while the user is moving.

Here, the sound pickup unit may include at least two omnidirectional microphones, the wearable terminal may further include a synthesis unit operable to perform synthesis to form a directional sensitivity by synthesizing input signals from the omnidirectional microphones. Thus, a synthesized signal is generated, and if motion is detected by the detection unit, the switch by the switching unit may be performed by switching from outputting the synthesized signal generated by the synthesis unit to outputting one of the original input signals from the omnidirectional microphones.

Since directivity is created by using a plurality of omnidirectional microphones and synthesizing the acoustic signals from the plurality of omnidirectional microphones, targeted audio can be sensitively picked up even if a separate directional microphone is not provided. Using input from either one of the omnidirectional microphones when there is a large amount of motion enables preventing a reduction in sound quality even when performing sound pickup while the user is moving.

Here, the comparison subunit may compare the displacement amount to one of a plurality of separately set thresholds depending on a direction in which the motion has occurred.

Since the angular velocity expressing the amount of motion is compared to separately set thresholds for each direction of motion, directivity switching can be performed in such a way as to sensitively respond to even a small amount of motion. For example, switching can be performed by setting a smaller threshold for the reference axis direction of the microphone, in which even a small amount of motion generates a large amount of noise, and by setting a larger threshold for motion that does not displace the microphone in the reference axis direction, which is not likely to generate noise.

Here, the switch by the switching unit may be performed with use of cross-fade processing.

When switching directivity, performing cross-fade processing enables reducing auditory discomfort. In cross-fade processing, rather than switching instantaneously, the output component of the microphone used before the switch is gradually decreased, and at the same time, the output component of the microphone to be used after the switch is gradually increased.

DESCRIPTION OF THE CHARACTERS

Figure 1A:
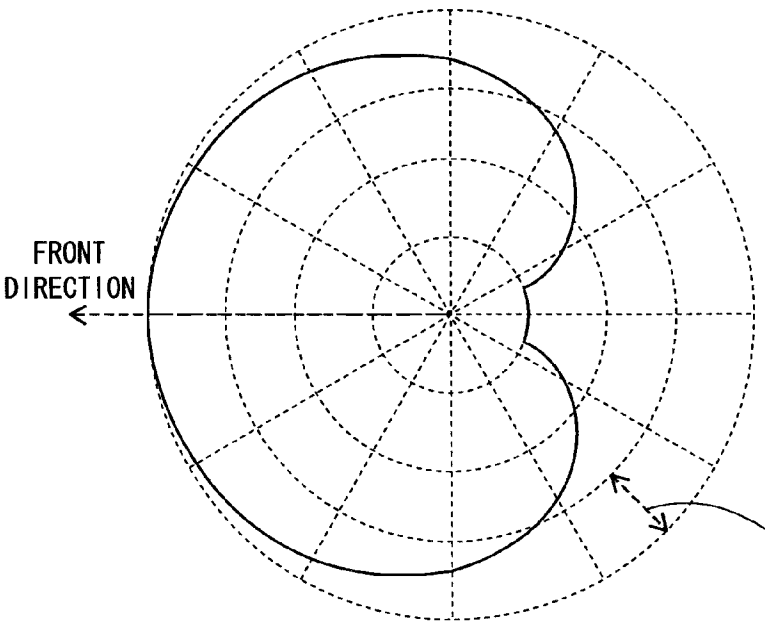
FIG. 1A shows a directivity characteristic pattern pertaining to sensitivity of a unidirectional microphone.

110: unidirectional microphone
120: omnidirectional microphone
121: omnidirectional microphone
200: gyroscope
210: A/D converter
220: clock
310: multiplier
311: multiplier
320: comparator
321: comparator
330: directivity selection unit
340: directivity synthesis unit
341: delay subunit
342: switch
343: subtracter
344: equalizer
350: impulse detection unit
351: arithmetic operation subunit
352: register
360: delay unit
361: delay unit
400: encoding unit
410: recording unit
420: delivery unit
500: image pickup device
510: image shake detection unit
511: frame memory
512: motion vector calculation subunit

DETAILED DESCRIPTION OF THE INVENTION

Embodiment 1

Embodiment 1 of the present invention describes a wearable terminal that switches between a directional microphone and an omnidirectional microphone according to an amount of motion detected by a gyroscope.

Figure 3A:
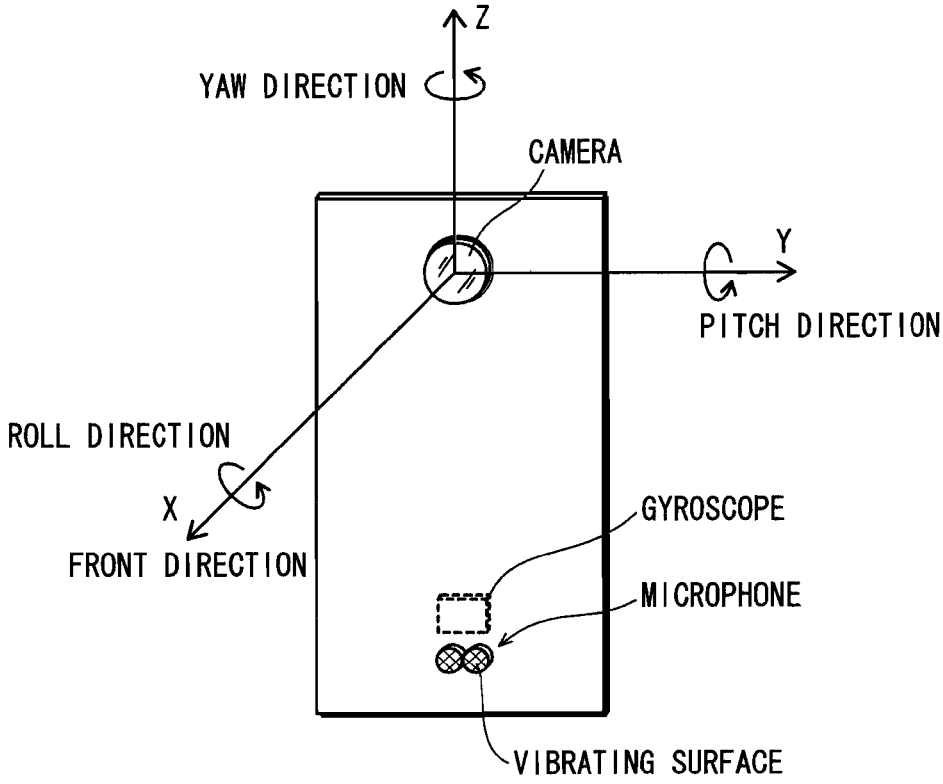
FIG. 3A shows a wearable terminal.
Figure 3B:
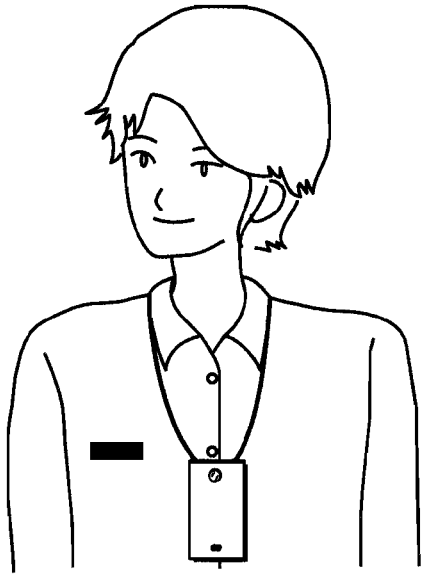
FIG. 3B shows a use mode of the wearable terminal.
Figure 4A:
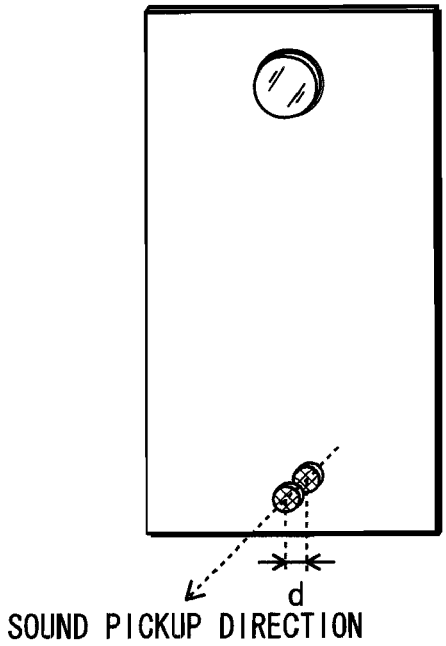
FIGS. 4A and 4B show sound pickup directions of microphones installed in the wearable terminal.
Figure 4B:
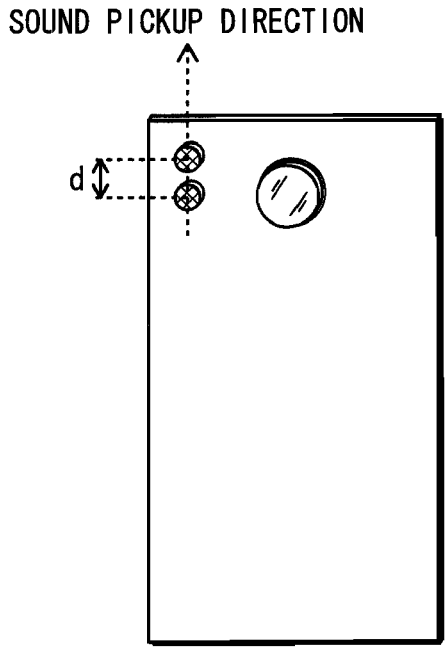

FIG. 3A is an outer view of the wearable terminal pertaining to embodiment 1 of the present invention. The wearable terminal incorporates a camera for acquiring video from the front direction, a microphone for picking up audio etc., and a gyroscope for detecting motion of the wearable terminal. The wearable terminal has a thin, card-like shape, and the microphone is installed so that a reference axis thereof faces the same front direction as the camera. As shown in FIG. 3B, the wearable terminal is anticipated to be hung around the neck of the user during use. The directivity of the directional microphone is not necessarily facing the same direction as the reference axis of the microphone, and as shown in FIGS. 4A and 4B, may face the direction of a speaker that is targeted for video pickup by the camera, or may face upward to pick up the voice of the user.

The following describes the relationship between the reference axis of the microphone and the vibrating surface. The microphone is a device that detects sound waves that are vibrations in the air, converts the sound waves to electric signals, and has a vibrating surface for sensing sound pressure. The vibrating surface, though not limited to being a plane, is a shape that normally has, or nearly has, axial symmetry, and the axis of symmetry is called the reference axis (see IEC60050-801). The microphone is structured such that the contact area between the vibrating surface and the air is large in the reference axis direction. When the vibrating surface is a plane, the reference axis and the vibrating surface are perpendicular to each other. Hereinafter, for convenience, the vibrating surface is described as a plane that is perpendicular to the reference axis, even though there are cases in which the vibrating surface is not a plane.

Figure 5:
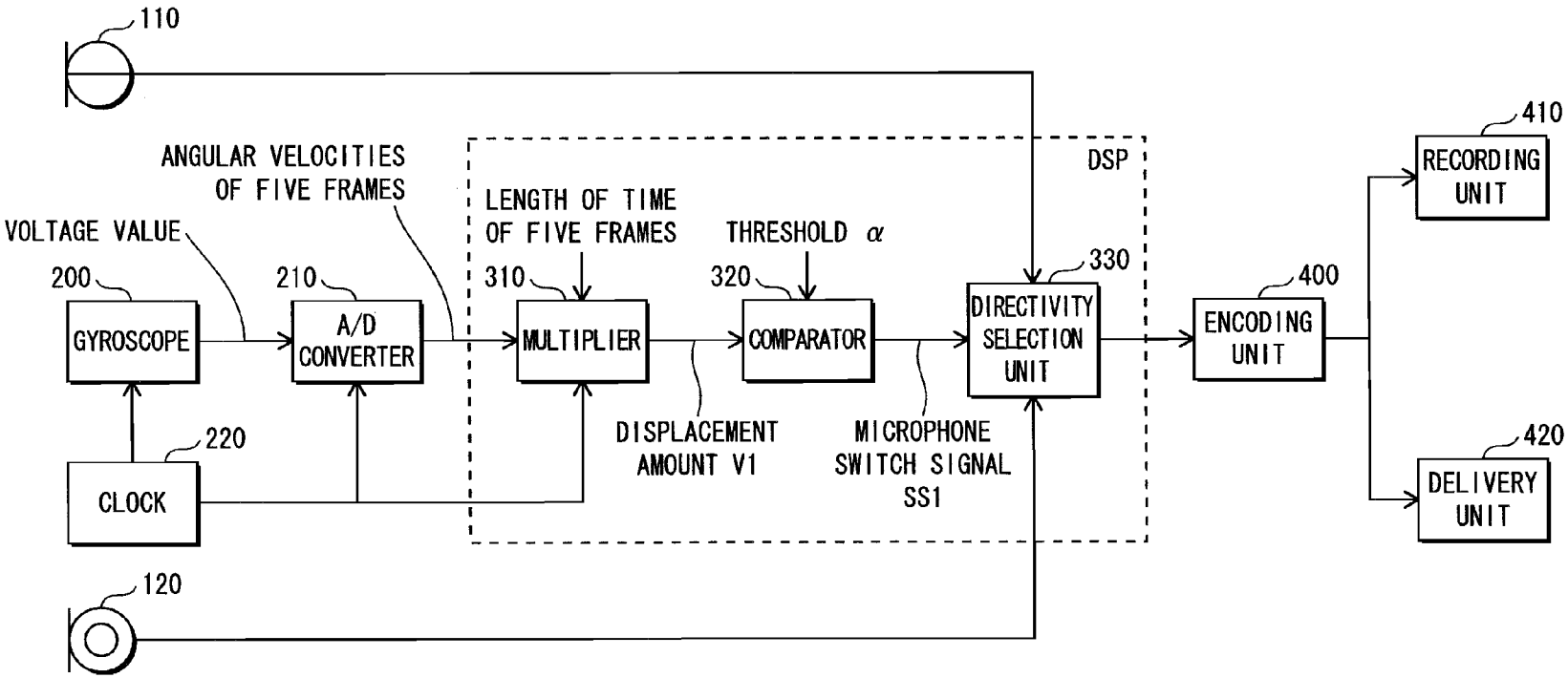
FIG. 5 is a block diagram showing a structure of the wearable terminal pertaining to embodiment 1 of the present invention.

FIG. 5 is a block diagram showing the structure of the wearable terminal pertaining to embodiment 1 of the present invention. The wearable terminal pertaining to embodiment 1 of the present invention performs sound pickup by inputting an angular velocity detected by a gyroscope 200 to a DSP (Digital Signal Processor) via an A/D converter 210, judging an amount of motion, and switching between a unidirectional microphone 110 and an omnidirectional microphone 120. The gyroscope 200, the A/D converter 210, and the DSP are synchronized to a clock 220. The audio data that is picked up is encoded by an encoding unit 400 and transferred to a recording unit 410 for recording on a recording medium such as an SD card, or to a delivery unit 420 for live delivery in a LAN, etc.

The following describes the particulars of the constituent elements.

Figure 1B:
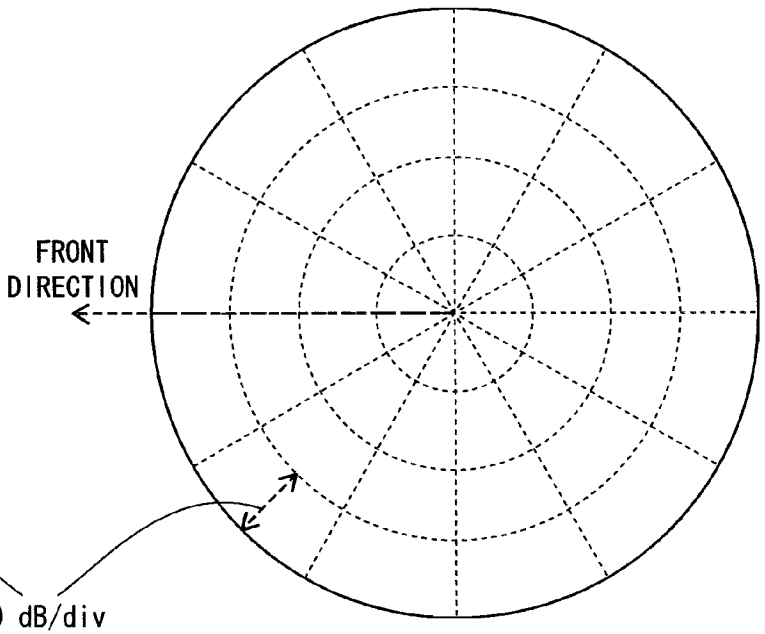
FIG. 1B shows a directivity characteristic pattern pertaining to sensitivity of an omnidirectional microphone.

The unidirectional microphone 110 is a microphone that demonstrates a high degree of sensitivity to sound from a specified direction, and the omnidirectional microphone 120 is a microphone that picks up sound from every direction with equal sensitivity. These directivity characteristic patterns are shown in FIGS. 1A and 1B. Various types of microphone components, such as capacitor type and dynamic type, are used for microphones, and all of these types have the problem of motion-related noise. A dynamic type microphone has resistance to a certain degree of motion, but is inferior to the capacitor type microphone with respect to sensitivity. Using a capacitor type microphone is preferable for obtaining a high degree of sensitivity while in a stable state having a small amount of motion, and in such a case, the motion resistance measures of the present invention are all the more important.

The gyroscope 200 is a general angular velocity sensor. The following describes, with reference to FIGS. 6A to 6C, directions of rotation of the angular velocity detected by the gyroscope 200. When a wearable terminal that has a microphone whose vibrating surface is facing front is hung from the neck as shown in FIG. 3B, an X axis lies in front, a Z axis points upward vertically, and a Y axis lies in a perpendicular direction to the X axis and the Z axis, as shown in FIG. 3A. At this time, the vibrating surface of the microphone is parallel to the plane YZ, and the reference axis is parallel to the X axis. The directions of motion of the wearable terminal can be classified into three types, namely roll direction, pitch direction and yaw direction.

Figure 6A:
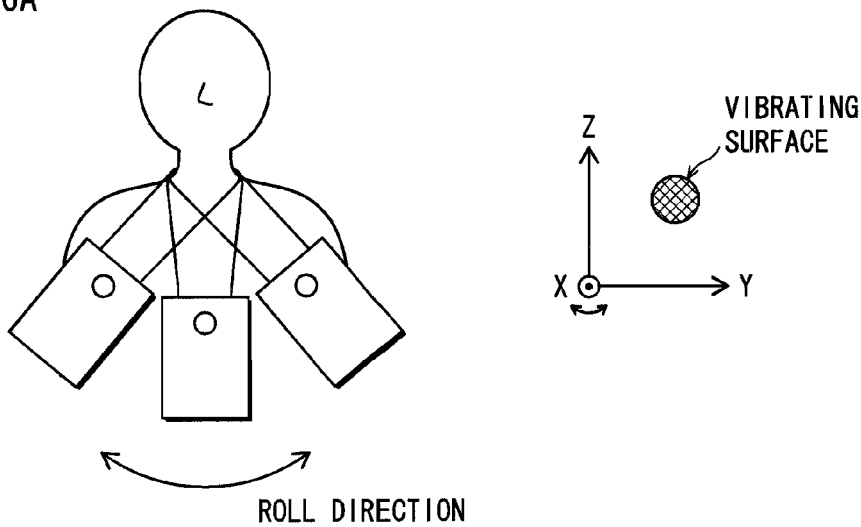
FIGS. 6A to 6C show rotation directions of the wearable terminal pertaining to embodiment 1 of the present invention.

FIG. 6A shows rotation around the X axis, and this rotation direction is called the roll direction. Motion in the roll direction is motion occurring when the wearable terminal hanging from the neck oscillates in a direction parallel to the body. Since this type of motion does not cause displacement in the vibrating surface of the microphone in the reference axis direction, noise is unlikely to occur. For motion in the roll direction, the gyroscope 200 outputs an angular velocity of rotation around the X axis.

Figure 6B:
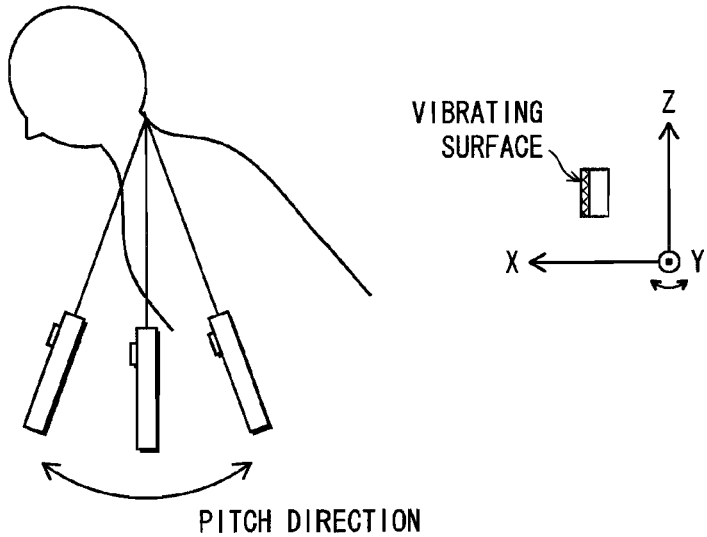

FIG. 6B shows rotation around the Y axis, and this rotation direction is called the pitch direction. Motion in the pitch direction is motion occurring when the wearable terminal hanging from the neck moves closer to and farther from the body. Since this type of motion causes a large amount of displacement of the vibrating surface of the microphone in the reference axis direction, even a small amount of motion causes a large amount of noise. Furthermore, since a large amount of noise occurs when the wearable terminal collides with the body, noise resistance measures for motion in this direction are the most important. For motion in the pitch direction, the gyroscope 200 outputs an angular velocity of rotation around the Y axis.

Figure 6C:
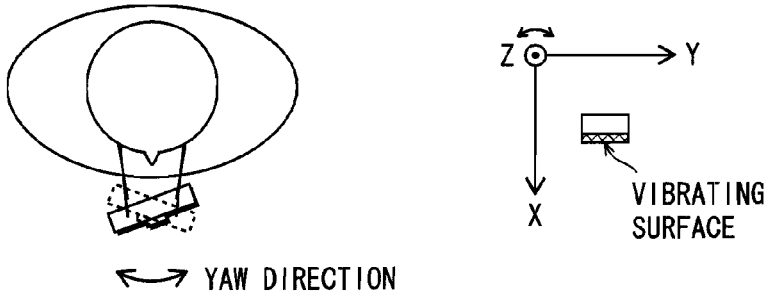

FIG. 6C shows rotation around the Z axis, and this rotation direction is called the yaw direction. Motion in the yaw direction is motion that occurs when the wearable terminal hanging from the neck oscillates, causing the neck strap to twist. Although this type of motion causes the vibrating surface of the microphone to be displaced in the reference axis direction, since the amount of displacement is small, the motion does not cause a large amount of noise. For motion in the yaw direction, the gyroscope 200 outputs an angular velocity of rotation around the Z axis.

Since the probability of noise occurring depends on the direction of motion, as described above, detecting the direction of motion is important.

Note that when there are a plurality of microphones whose reference axes are not parallel, the reference axis direction may be thought of as the reference axis direction of the microphone for which noise suppression is most desired, or as the direction in which noise is most likely to occur in all of the microphones.

With respect to motion in the pitch direction that is most likely to generate noise, the wearable terminal pertaining to embodiment 1 of the present invention detects an angular velocity and performs control to switch directivity. The gyroscope 200 may be a triaxial gyroscope that detects the angular velocity in each of the roll direction, the pitch direction and the yaw direction, or a single axis gyroscope that only detects the angular velocity in the pitch direction. If the gyroscope 200 is a triaxial gyroscope, only the angular velocity in the pitch direction is used by the DSP. The gyroscope 200 outputs a voltage value corresponding to the detected angular velocity to the A/D converter 210.

The A/D converter 210 receives the voltage value output by the gyroscope 200 as input, converts the voltage value to a digital value, and outputs the digital value to the DSP. The A/D converter 210 operates according to a clock signal output by the clock 220. The A/D converter obtains a digital value by averaging voltage values from a sufficient number of sampling frames so as to enable detecting changes in motion, and outputs the digital value.

Figure 7:
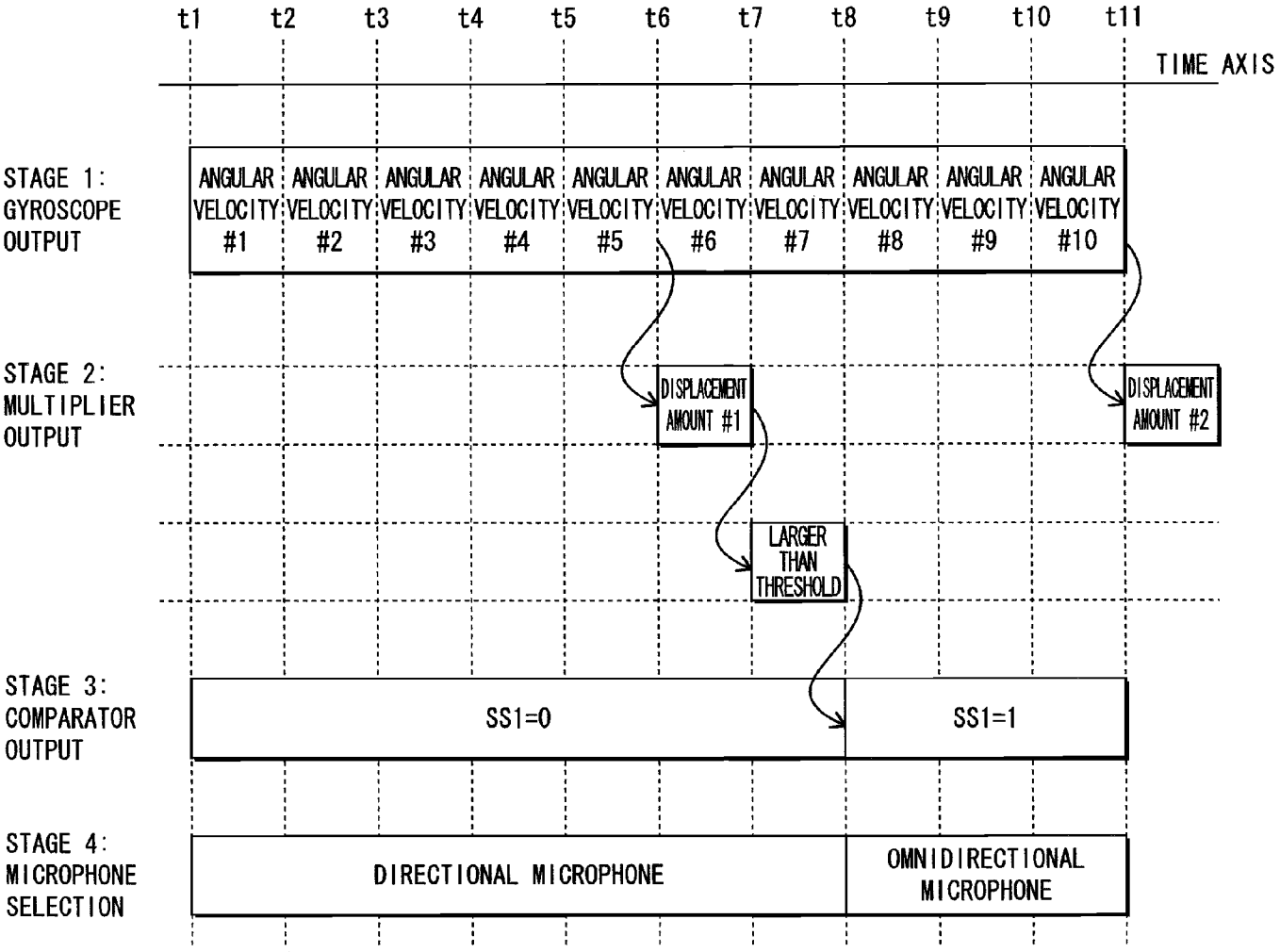
FIG. 7 is a timing chart indicating operations performed by the wearable terminal pertaining to embodiment 1 of the present invention.

FIG. 7 illustrates this with use of a timing chart showing directivity switching control of the wearable terminal pertaining to embodiment 1 of the present invention. Points t1, t2, etc. on the time axis in FIG. 7 each represent a starting point of a clock cycle. As shown in stage 1 of FIG. 7, the gyroscope 200 detects angular velocities #1, #2, etc. for each frame corresponding to one clock cycle, and outputs the corresponding voltage value. The A/D converter 210 integrates five frames worth of angular velocities from an angular velocity #1 to an angular velocity #5, and outputs an averaged value indicating a length of time of the five frames to a multiplier 310.

The DSP receives the digital value output by the gyroscope 200 as input, judges whether the amount of motion is larger than a threshold, and switches between the unidirectional microphone 110 and the omnidirectional microphone 120 in accordance with a result of the judgment. The DSP includes the multiplier 310, a comparator 320, and a directivity selection unit 330.

The multiplier 310 multiplies the length of time of the five frames by the digital value that indicates the angular velocities of the five frames and that was input by the A/D converter 210 to obtain a displacement amount, which is an average angular degree that the image has changed in the length of time of the five frames. This displacement amount is an indicator of the amount of motion. At a timing t6 when five frames worth of angular velocities output by the gyroscope 200 have accumulated, as shown in stage 2 of FIG. 7, the multiplier 310 calculates a displacement amount #1 and outputs the displacement amount #1 to the comparator 320.

The comparator 320 compares the displacement amount obtained by the multiplier 310 to a predetermined threshold, and outputs a microphone switch signal SS1. When the displacement amount is smaller than or equal to the threshold, the comparator 320 outputs SS1=0, and when the displacement amount is larger than the threshold, the comparator 320 outputs SS1=1. For example, at timing t1 in FIG. 7, the comparator 320 outputs the microphone switch signal SS1=0 when the amount of motion is smaller than or equal to the threshold. As shown in stage 3 of FIG. 7, at timing t7, the comparator 320 judges that the displacement amount is larger than the threshold, and from timing t8 onward, outputs the microphone switch signal SS1=1.

The directivity selection unit 330 selects the unidirectional microphone 110 when the microphone switch signal SS1 output by the comparator 320 is SS1=0, and selects the omnidirectional microphone 120 when SS1=1. The directivity selection unit 330 outputs an input signal from the selected microphone as is. For example, as shown in stage 4 of FIG. 7, the unidirectional microphone 110 is selected until timing t8, when the microphone switch signal is changed by the comparator 320, and the omnidirectional microphone 120 is selected from timing t8 onward.

Figure 8:
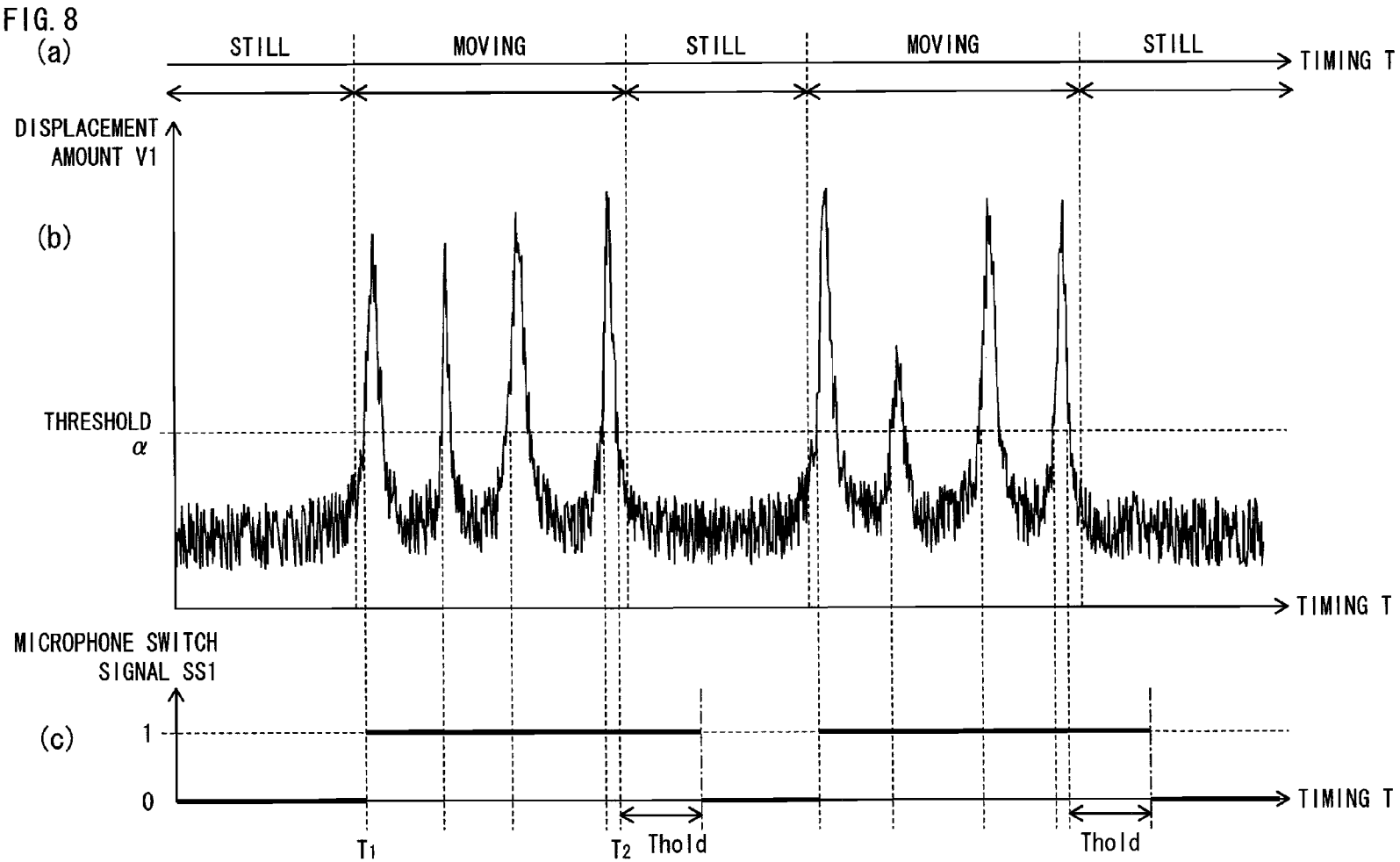
FIG. 8 diagrammatically represents control for switching the directivity of the wearable terminal pertaining to embodiment 1 of the present invention.

FIG. 8 diagrammatically represents motion occurring when the wearable terminal is in actual use and is worn on the body, and a directivity switch in such a case. FIG. 8(*a*) indicates time slots when the user is still and time slots when the user is moving. FIG. 8(*b*) plots time changes of a displacement amount V1 calculated based on the angular velocity detected by the gyroscope 200. When the user is still, the displacement amount V1 has a lower value than the threshold α, and when the user moves, the displacement amount V1 spikes upward. FIG. 8(*b*) shows that, although the displacement amount V1 may momentarily fall below the threshold a when the user is moving, V1 is highly likely to rise above the threshold a again within a short time period. FIG. 8(*c*) plots time changes of the microphone switch signal SS1 output by the comparator 320. At first, since the displacement amount V1 is smaller than or equal to the threshold α, the comparator 320 outputs SS1=0. When the user begins to move, at the timing T1 that is when the displacement amount V1 first becomes larger than the threshold α, the comparator 320 outputs SS1=1. Although the displacement amount V1 falls below the threshold a several times while the user is moving, since frequently switching the directivity of the microphone would cause auditory discomfort, a holding time period called Thold has been established. Even if the displacement amount V1 falls below the threshold α, the comparator 320 continues to output SS1=1 during the time period Thold.

Since the displacement amount V1 remains smaller than the threshold a even after the time period Thold has elapsed, the comparator 320 switches to outputting SS1=0 at the end of the time period Thold, which started from the timing T2 immediately before the motion stopped.

Figure 9:
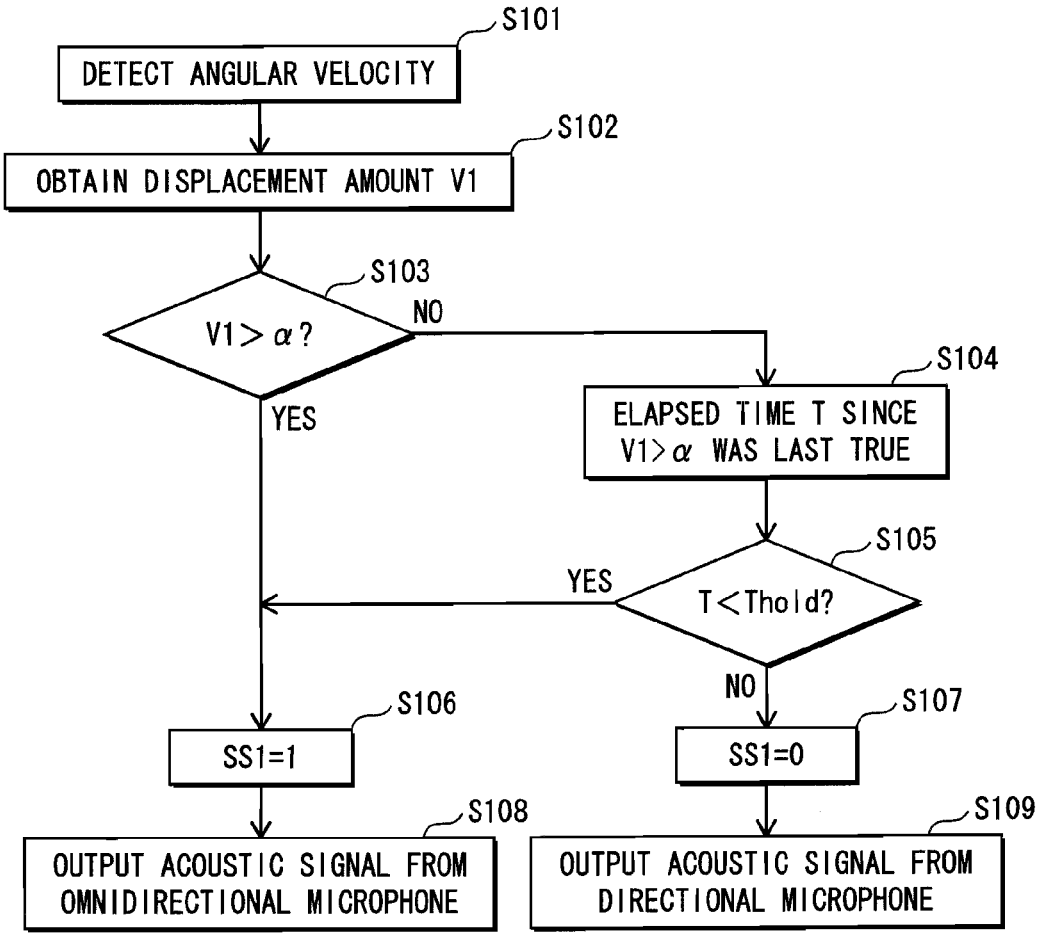
FIG. 9 is a flowchart indicating operations performed by the wearable terminal pertaining to embodiment 1 of the present invention.

FIG. 9 shows the above-described directivity switching operation as a flowchart. First, in step S101, the gyroscope 200 detects an angular velocity. The detected angular velocity is input to the multiplier 310 via the A/D converter 210. Next, in step S102, the multiplier 310 multiplies the angular velocity and the sampling time to obtain a displacement amount V1. In step S103, the comparator 320 compares the displacement amount V1 to the threshold $\alpha$, proceeds to step S104 if $V1 \leqq \alpha$, and proceeds to step S106 if $V1 > \alpha$. A value T, representing elapsed time since $V1 > \alpha$ was last true, is acquired in step S104. If $T \leqq Thold$ in step S105, step S106 is performed, and if $T > Thold$, step S107 is performed. In step S106, the comparator 320 outputs the microphone switch signal SS1=1, and in step S108, the directivity selection unit 330 selects the omnidirectional microphone 120. In step S107, the comparator 320 outputs the microphone switch signal SS1=0, and in step S109, the directivity selection unit 330 selects the unidirectional microphone.

As described above, the wearable terminal uses the unidirectional microphone 110 to sensitively pick up targeted audio when the amount of motion of the device is small, and uses the omnidirectional microphone 120 that is unlikely to be influenced by noise and whose sensitivity is not dependent on sound pickup direction when the amount of motion of the device is large. This structure enables the wearable terminal pertaining to embodiment 1 of the present invention to perform sound pickup that is unlikely to be influenced by the movements of the user.

Embodiment 2

Embodiment 2 of the present invention describes a wearable terminal that uses two omnidirectional microphones and switches between using one or both of the omnidirectional microphones according to an amount of motion detected by the gyroscope. When using both omnidirectional microphones, the wearable terminal employs a method of synthesizing directivity from the acoustic signals output by the two omnidirectional microphones.

The wearable terminal pertaining to embodiment 2 of the present invention performs primary sound pressure gradient type directivity synthesis with use of two omnidirectional microphones, and as shown in FIG. 4, the two omnidirectional microphones are arranged at distance d apart from each other. Directivity can be controlled by adjusting the configured positions of the omnidirectional microphones and the distance d. The voice of a person speaking to the user can be picked up sensitively by causing the sound pickup direction to face the front as shown in FIG. 4A, or the voice of the user can be picked up sensitively by causing the sound pickup direction to face upward as shown in FIG. 4B. This type of directivity synthesis is vulnerable to noise, and noise resistance measures must be taken, similarly to when the unidirectional microphone is used.

Figure 10:
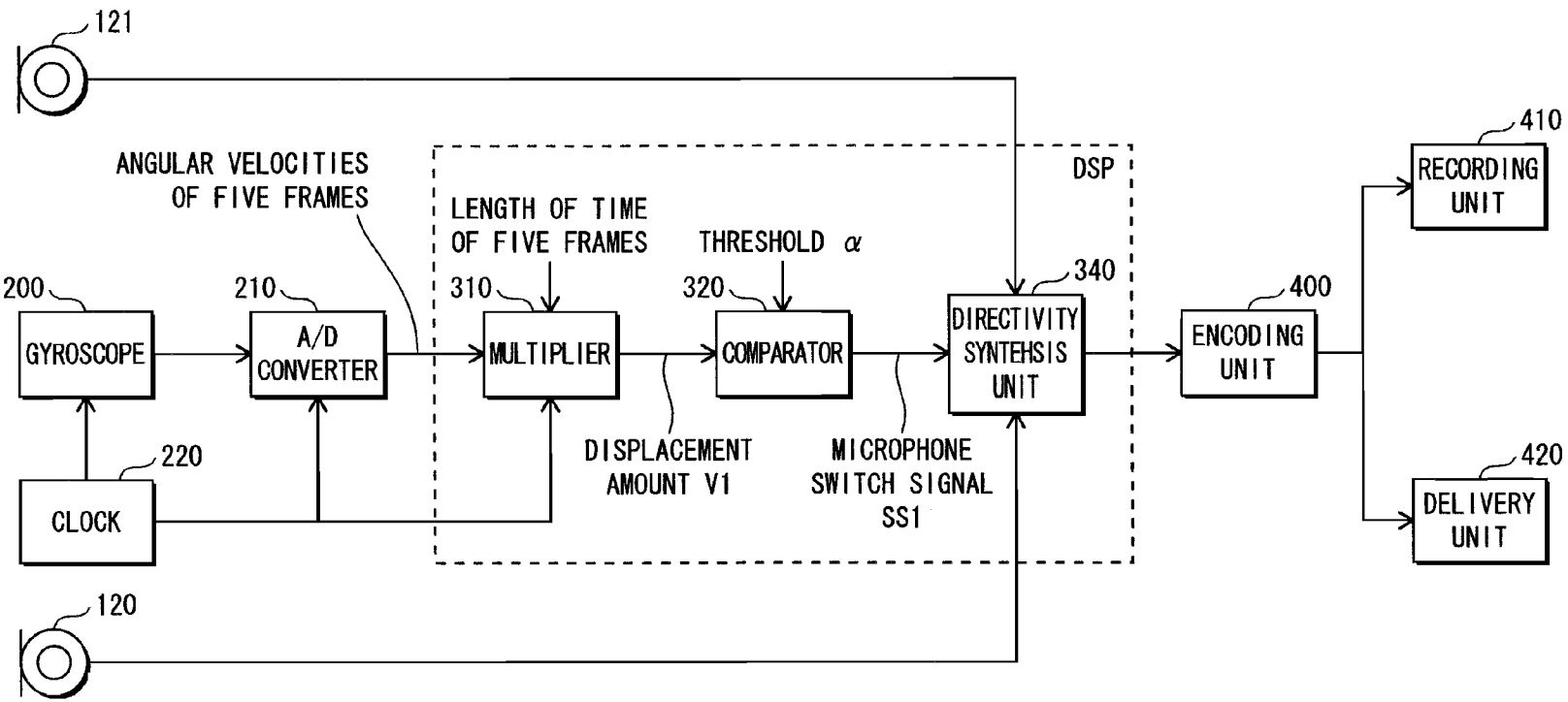
FIG. 10 is a block diagram showing a structure of a wearable terminal pertaining to embodiment 2 of the present invention.

FIG. 10 is a block diagram showing a structure of the wearable terminal pertaining to embodiment 2 of the present invention. Other than including an omnidirectional microphone 121 in place of the unidirectional microphone 110, and including the directivity synthesis unit 340 in place of the directivity selection unit 330, the wearable terminal pertaining to embodiment 2 of the present invention has the same structure as the wearable terminal pertaining to embodiment 1 shown in FIG. 5.

The wearable terminal pertaining to embodiment 2 of the present invention is the same as the wearable terminal pertaining to embodiment 1 in that directivity is switched by converting the angular velocity detected by the gyroscope 200 into the displacement amount V1 with use of the multiplier 310 and comparing a threshold $\alpha$ thereto with use of the comparator 320.

The following describes the directivity synthesis unit 340 of the wearable terminal pertaining to embodiment 2 of the present invention.

When the microphone switch signal SS1 output by the comparator 320 is 0, the directivity synthesis unit 340 of the wearable terminal pertaining to embodiment 2 of the present invention causes a phase shift between signals input by the omnidirectional microphone 120 and the omnidirectional microphone 121, performs subtraction processing to synthesize directivity, and outputs the signal having synthesized directivity. Also, when the microphone switch signal SS1 output by the comparator 320 is 1, the directivity synthesis unit 340 outputs one of the signals input by the two omnidirectional microphones as is.

Figure 11:
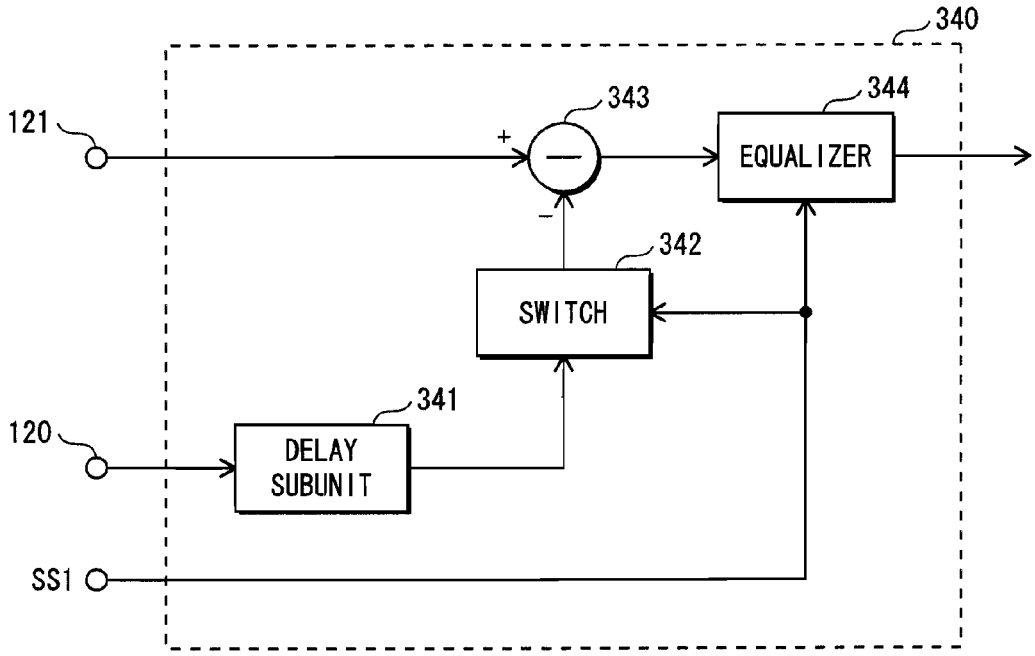
FIG. 11 is a block diagram showing a structure of a directivity synthesis unit of the wearable terminal pertaining to embodiment 2 of the present invention.

FIG. 11 is a block diagram showing the structure of the directivity synthesis unit 340 of the wearable terminal pertaining to embodiment 2 of the present invention. The directivity synthesis unit 340 includes a delay subunit 341, a switch 342, a subtracter 343, and an equalizer 344.

The delay subunit 341 delays the phase of the signal input by the omnidirectional microphone 120. Letting d be the distance between the vibrating surfaces of the two omnidirectional microphones and c be acoustic velocity, a delay time $\tau$ is defined as $\tau = d/c$. Here, the acoustic velocity c is a constant value of approximately 340 m/s.

The switch 342 is a switch that controls whether or not directivity synthesis is performed in accordance with the microphone switch signal SS1 output by the comparator 320. When SS1 is 0, the switch 342 outputs the signal input by the delay subunit 341 to the subtracter 343 as is. When SS1 is 1, the switch 342 blocks the signal input by the delay subunit 341 since directivity synthesis is not performed.

The subtracter 343 performs subtraction processing by giving a negative sign to a signal that has passed through the switch 342, and adding this negative signal to the signal input by the omnidirectional microphone 121. If the signal input by the omnidirectional microphone 120 is blocked by the switch 342, the subtracter 343 outputs the signal input by the omnidirectional microphone 121 as is.

In accordance with the microphone switch signal SS1 output by the comparator 320, the equalizer 344 amplifies the low frequency area of the signal on which the subtracter 343 has performed subtraction processing. When SS1 is 0, the low-frequency area is amplified since low frequency sensitivity decreases when directivity synthesis is performed. A value determined in advance during the design stage is used to determine the scope and extent of amplification, etc. When SS1 is 1, since directivity synthesis is not performed, amplification processing is not necessary, and the signal input by the subtracter 343 is output as is.

As described above, the wearable terminal pertaining to embodiment 2 enables increasing the sensitivity to sound from a pickup target when the amount of motion is small by synthesizing the signals from the two omnidirectional microphones to synthesize directivity, and preventing a reduction in sensitivity to sound from the pickup target when the amount of motion is large by using input from only one of the omnidirectional microphones.

Embodiment 3

Embodiment 3 of the present invention describes the wearable terminal that detects an amount of motion based on images taken by a camera, and switches between a directional microphone and an omnidirectional microphone according to the amount of motion.

Figure 12:
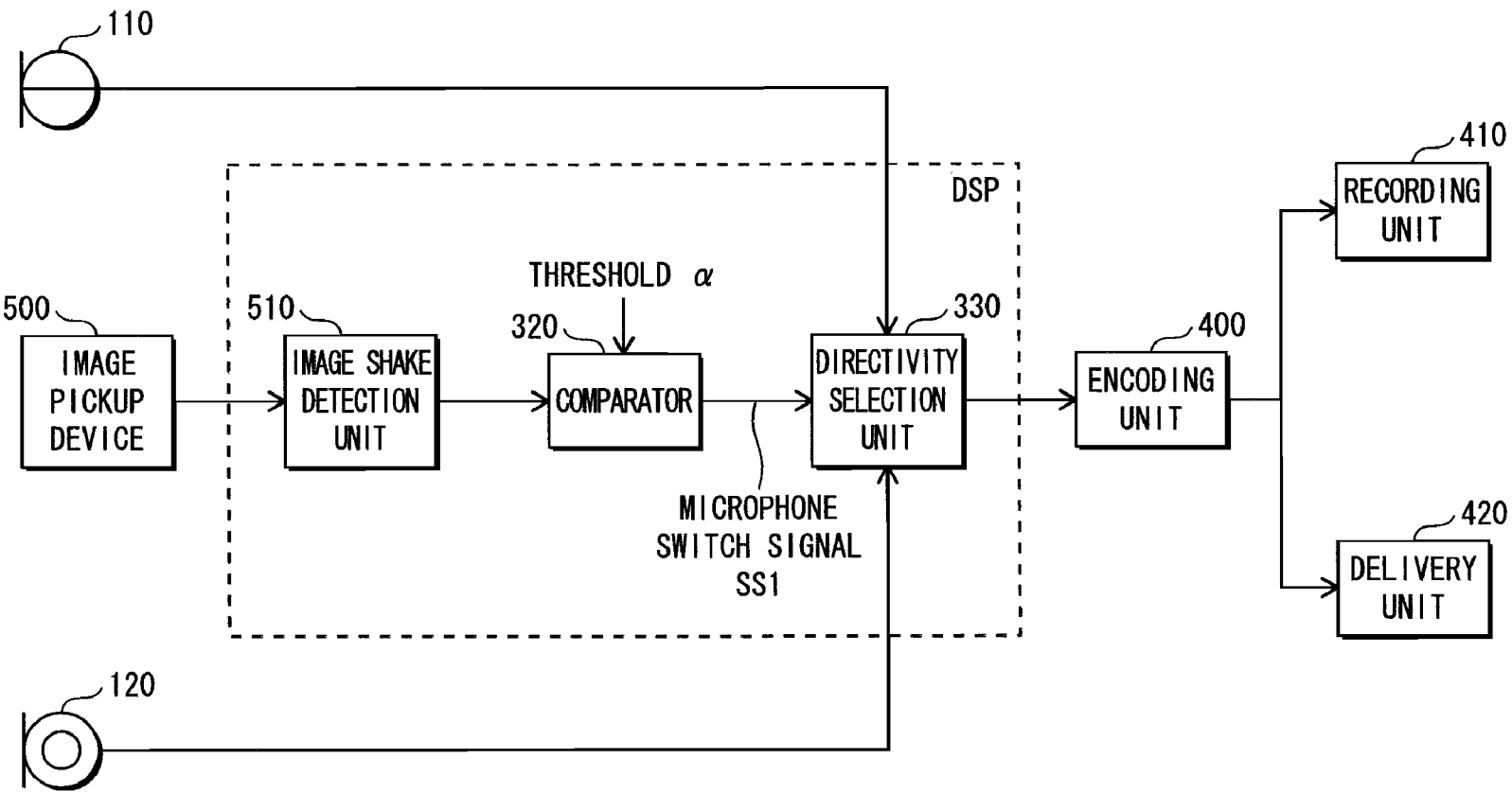
FIG. 12 is a block diagram showing a structure of a wearable terminal pertaining to embodiment 3 of the present invention.

FIG. 12 is a block diagram showing a structure of a wearable terminal pertaining to embodiment 3 of the present invention. The wearable terminal pertaining to embodiment 3 of the present invention has the same structure as the wearable terminal pertaining to embodiment 1, except for the following. Instead of using the angular velocity detected by the gyroscope 200 of the wearable terminal pertaining to embodiment 1 shown in FIG. 5, the wearable terminal pertaining to embodiment 3 of the present invention uses images taken by an image pickup device 500. Instead of detecting the displacement amount with use of the multiplier 310, the wearable terminal pertaining to embodiment 3 detects whether shake occurs in an image with use of the image shake detection unit 510. The image pickup device 500 is a device such as a CCD camera or the like that picks up an image and outputs the image as an electric signal.

With use of the image shake detection unit 510, the wearable terminal pertaining to embodiment 3 of the present invention detects image shake based on a series of images picked up by the image pickup device 500 during a predetermined interval of time. Thereafter, similarly to embodiment 1, the comparator 320 compares the quantified amount of shake to the threshold $\alpha$, and the directivity selection unit 330 switches between outputting a signal input by the unidirectional microphone and a signal input by the omnidirectional microphone 120 in accordance with the microphone switch signal SS1.

The following describes the image shake detection unit 510 of the wearable terminal pertaining to embodiment 3 of the present invention.

Figure 13:
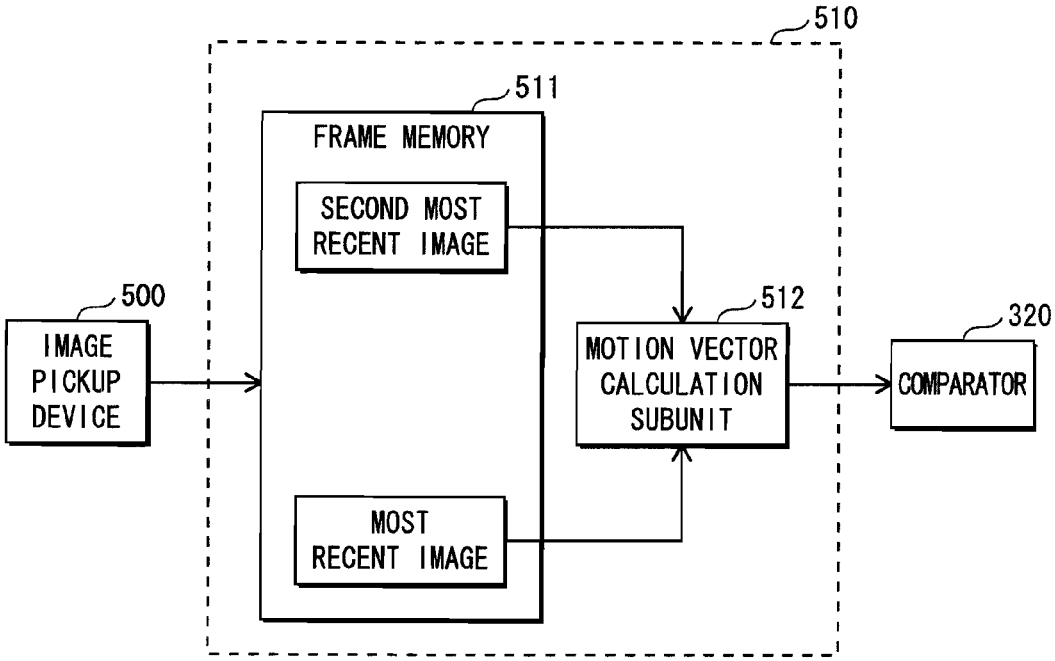
FIG. 13 is a block diagram showing a structure of an image shake detection unit of the wearable terminal pertaining to embodiment 3 of the present invention.

FIG. 13 is a block diagram showing the structure of the image shake detection unit 510 of the wearable terminal pertaining to embodiment 3 of the present invention. The image shake detection unit 510 includes a frame memory 511 and a motion vector calculation subunit 512.

The frame memory 511 stores the two most recent images that have been input by the image pickup device 500.

By comparing the most recent image and the second most recent image stored in the frame memory 511, the motion vector calculation subunit 512 detects the motion of the wearable terminal, and quantifies the amount of motion. For example, a method for calculating an amount of motion is disclosed in patent document 2. In the method of patent document 2, each image is partitioned into blocks on a grid, the most recent image and the second most recent image are compared on a block-by-block basis, and the amount of motion in the image pickup target is calculated based on a motion vector representing movement of the image in each block. Assuming that the image pickup target is not moving, this can be taken to indicate that the wearable terminal is moving. Also, the method of detection is not limited to this method, and provided that image processing can be used to detect motion, another method may be used.

Figure 14:
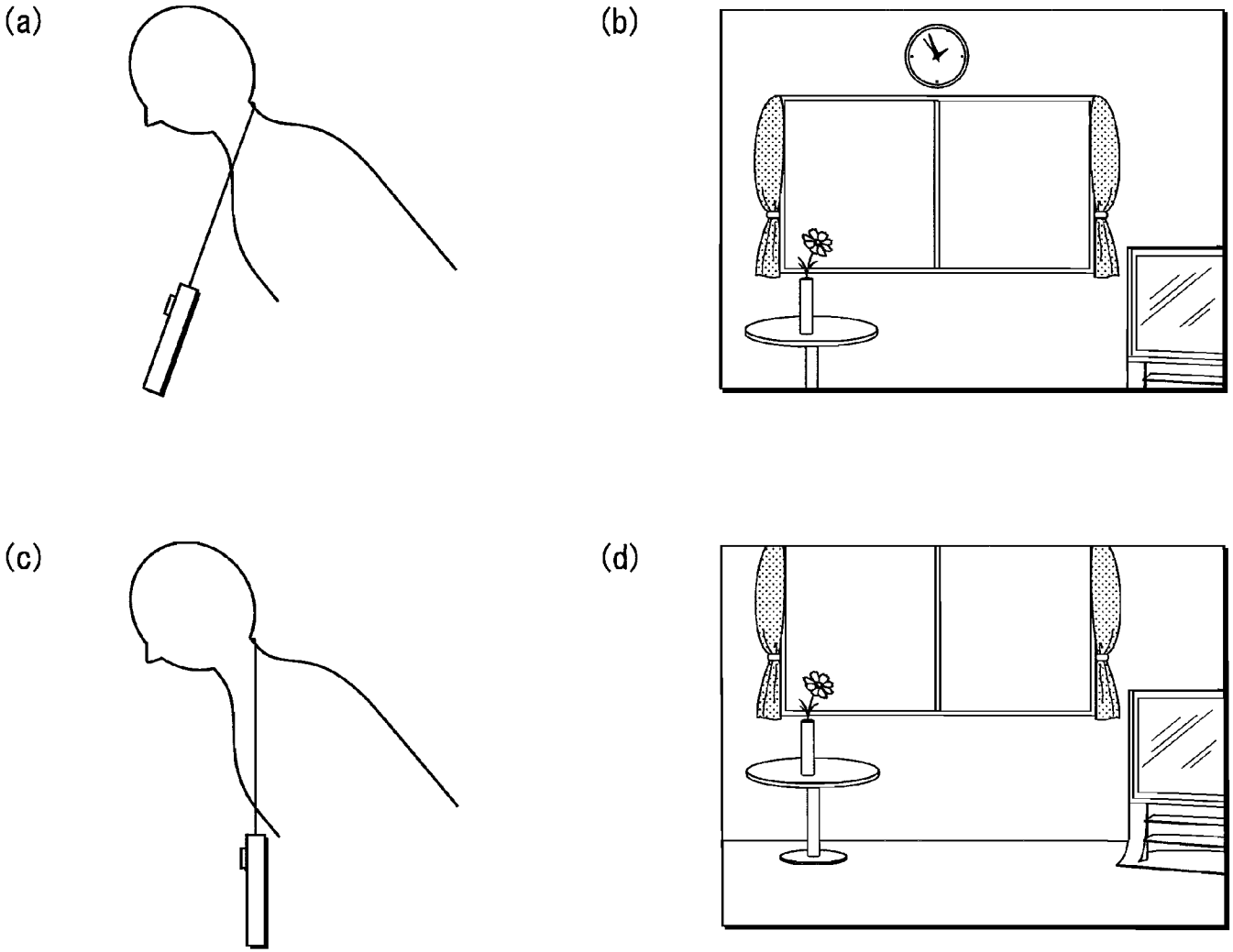
FIG. 14 illustrates an image shake detection method of the wearable terminal pertaining to embodiment 3 of the present invention.

For example, the following describes a case in which a wearable terminal hanging from the neck moves in a front-to-back direction, as shown in FIGS. 14(*a*) and 14(*c*). An image picked up when the wearable terminal has moved forward, as shown in FIG. 14(*a*), is depicted in FIG. 14(*b*). In contrast, an image picked up when the wearable terminal is hanging still in a vertical direction, as shown in FIG. 14(*c*), is depicted in FIG. 14(*d*). Since a comparison of these two images indicates an overall shift from up to down, a judgment is made that the wearable terminal is moving in the pitch direction. Also, the amount of motion can be estimated by analyzing the size of the shift and changes in size of the objects targeted for image pickup.

As described above, the wearable terminal can detect motion thereof based on images picked up by the image pickup device 500 and switch the directivity of the microphone according to the amount of motion.

A wearable terminal generally includes an image pickup device, and performs video recording at the same time as audio recording. Since additional installation of a gyroscope or the like is not necessary for detecting motion, detecting motion with use of images picked up by the image pickup device is advantageous for a wearable terminal having a compact size.

Embodiment 4

Embodiment 4 of the present invention describes a wearable terminal that detects impulsive motion, such as the impact of the wearable terminal colliding with the body, and performs switching in accordance with the size of the impact with use of a method of synthesizing directivity from acoustic signals output by two omnidirectional microphones.

Figure 2:
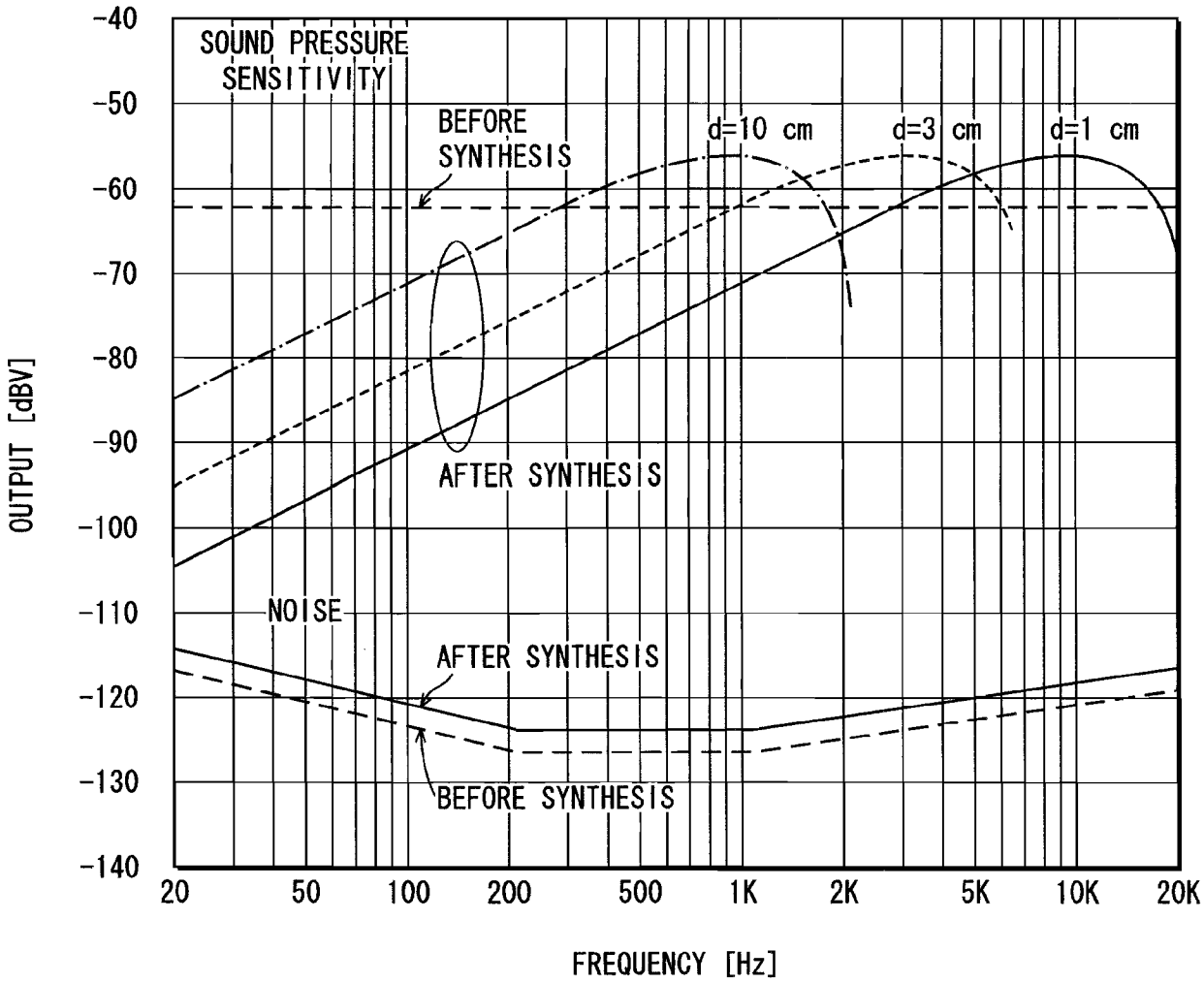
FIG. 2 shows frequency characteristics pertaining to sensitivity of the unidirectional microphone and the omnidirectional microphone.
Figure 15:
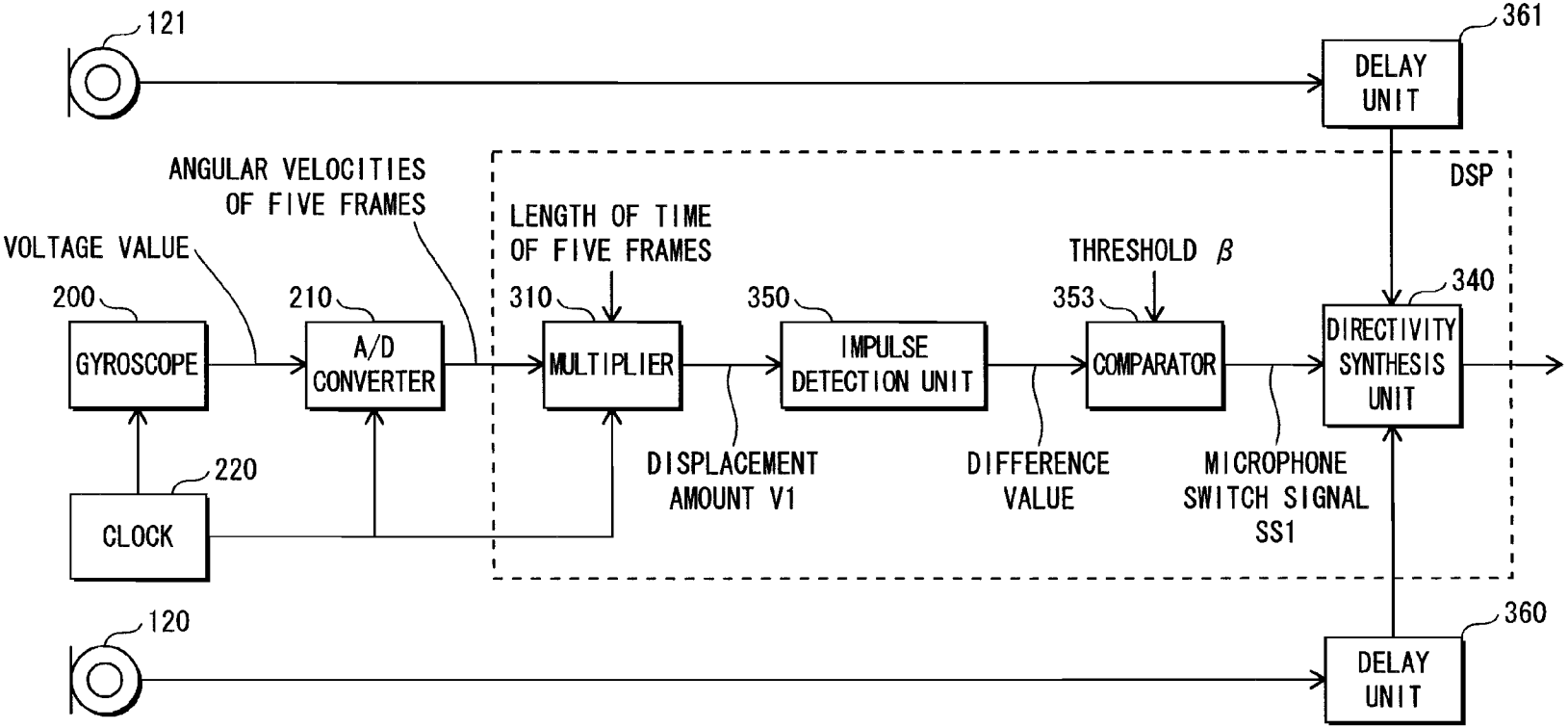
FIG. 15 is a block diagram showing a structure of a wearable terminal pertaining to embodiment 4 of the present invention.

FIG. 15 is a block diagram showing the structure of the wearable terminal pertaining to embodiment 4 of the present invention. Other than inserting an impulse detection unit 350 between the multiplier 310 and the comparator 353 and adding a delay unit 360 and a delay unit 361, the wearable terminal pertaining to embodiment 4 of the present invention has the same structure as the wearable terminal pertaining to embodiment 2 shown in FIG. 2.

Until, and including, when the multiplier 310 converts the angular velocity detected by the gyroscope 200 into the displacement amount V1, processing by the wearable terminal pertaining to embodiment 4 of the present invention is the same as in embodiment 2. Also, the directivity synthesis by performing subtraction processing between the signals output by two omnidirectional microphones in accordance with the microphone switch signal SS1 output by the comparator 320 is the same as in embodiment 2.

The following describes the impulse detection unit 350 of the wearable terminal pertaining to embodiment 4 of the present invention.

Figure 16:
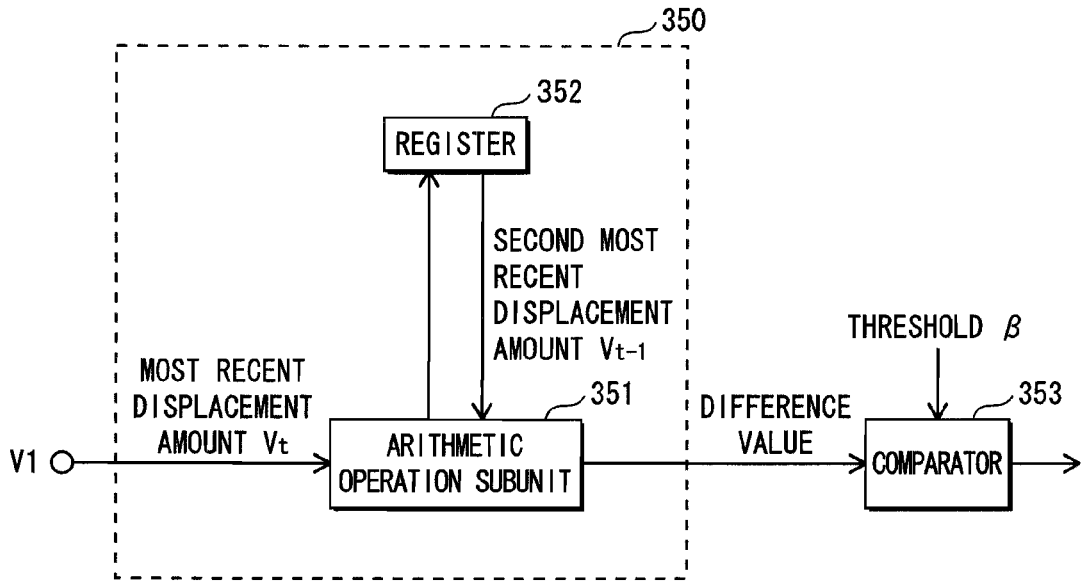
FIG. 16 is a block diagram showing a structure of an impulse detection unit of the wearable terminal pertaining to embodiment 4 of the present invention.

FIG. 16 is a block diagram showing the structure of the impulse detection unit 350 of the wearable terminal pertaining to embodiment 4 of the present invention. The impulse detection unit 350 includes an arithmetic operation subunit 351 and a register 352.

The arithmetic operation subunit 351 calculates a difference value between displacement amounts V1 output by the multiplier 310, and outputs the difference value to the comparator 320. Letting Vt be the displacement amount output by the multiplier 310 at a timing t, and letting Vt−1 be the displacement amount output by the multiplier 310 immediately before the timing t (t−1), the second most recent displacement amount, Vt−1, is held in the register 352. The arithmetic operation subunit 351 outputs the difference between the most recent displacement amount Vt input by the multiplier 310 and the second most recent displacement amount Vt−1 held in the register 352 (Vt−Vt−1) to the comparator 320. After the calculation, the register 352 is updated to hold the most recent displacement amount Vt.

As shown in FIG. 8, since the amount of fluctuation of the displacement amount V1 is small when the user is still, the difference values are also small. However, since the displacement amount V1 fluctuates rapidly immediately after the user begins to move and while the user is moving, the difference values are large. To measure this type of impulsive motion, the amount of motion is judged in comparison to a threshold β.

To detect impulsive motion, the impulse detection unit 350 obtains a difference value of the displacement amounts V1. Therefore, there is a delay in the microphone switch signal SS1 output by the comparator 320 compared to the signal output by the microphone. To correct this delay, the delay unit 360 and the delay unit 361 have been inserted in order to delay the microphone output. These delay units output the microphone output signal after a delay of a constant time Timp. The delay time Timp corresponds to the time required for the impulse judgment, and is set in advance.

Similarly to embodiment 2, the microphone switch signal SS1 output by the comparator 320 is 1 when the difference value is larger than the threshold β (ss1=1), and 0 when the difference value is smaller than or equal to the threshold β (SS1=0).

Since impulsive motion is more likely to generate noise than normal motion, setting a looser judgment condition for impulsive motion enables preventing a reduction in sound pickup quality even when the user is moving.

Embodiment 5

Embodiment 5 of the present invention describes a wearable terminal that judges an amount of motion with use of separate thresholds (conditions) for each direction of motion, and switches between a directional microphone and an omnidirectional microphone according to the judged amount of motion in each direction.

Figure 17:
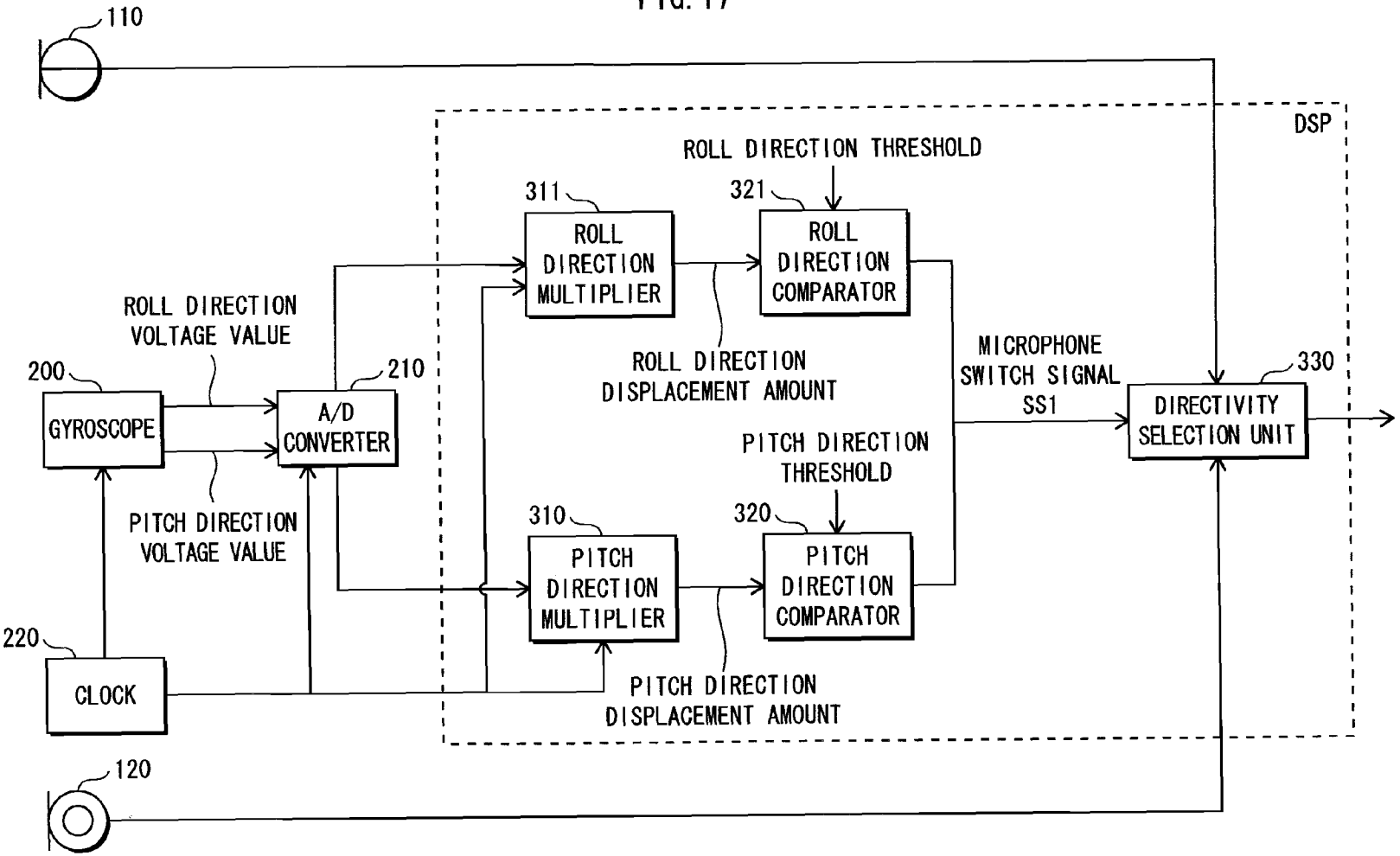
FIG. 17 is a block diagram showing a structure of a wearable terminal pertaining to embodiment 5 of the present invention.

FIG. 17 is a block diagram showing the structure of the wearable terminal pertaining to embodiment 5 of the present invention. Other than providing two multipliers, 310 and 311, and two comparators, 320 and 321, one of each pair corresponding to the pitch direction and the other one corresponding to the roll direction, the wearable terminal pertaining to embodiment 5 of the present invention has the same structure as the wearable terminal of embodiment 1 shown in FIG. 5. When the wearable terminal is hung from the neck during use as shown in FIG. 3B, due to the length of the neck strap, of the three directions shown in FIG. 6, motion in the pitch direction is the most likely to cause displacement of the vibrating surface of the microphone. The second most likely to cause displacement of the vibrating surface of the microphone is motion in the roll direction. In view of this, the wearable terminal pertaining to embodiment 5 of the present invention judges motion in the roll direction separately from the pitch direction. Similarly to embodiment 1, the wearable terminal pertaining to embodiment 5 of the present invention converts angular velocities detected by the gyroscope 200 to displacement amounts with use of the multipliers 310 and 311, compares the displacement amounts to a threshold with use of the comparators 320 and 321, which output a microphone switch signal, and the directivity selection unit 330, according to the microphone switch signal output by the comparators 320 and 321, selects either an acoustic signal input by the unidirectional microphone 110 or an acoustic signal input by the omnidirectional microphone 120 and outputs the selected signal.

However, the gyroscope 200 of the wearable terminal pertaining to embodiment 5 of the present invention is a biaxial gyroscope that can detect angular velocity in both the pitch direction and the roll direction. Also, the threshold for the pitch direction and the threshold for the roll direction are set separately. As motion that is perpendicular to the reference axis of the microphone, motion in the roll direction is not likely to cause noise, unlike motion in the pitch direction, which is motion in the direction of the reference axis of the microphone. Also, since collision of the wearable terminal with the body is likely to occur during motion in the pitch direction and unlikely to occur during motion in the roll direction, motion in the roll direction is less likely to cause noise for that reason as well. Accordingly, setting the threshold for motion in the pitch direction lower than the threshold for motion in the roll direction enables performing more sensitive noise resistance measures for motion in the pitch direction. In other words, the conditions under which switching occurs are different depending on the direction (e.g., pitch or roll) of the detected motion.

When either the microphone switch signal output by the comparator 320 or the microphone switch signal output by the comparator 321 is 0, the directivity selection unit 330 judges that the amount of motion is small, and outputs the signal input by the unidirectional microphone 110. When either of the microphone switch signal output by the comparator 320 or the microphone switch signal output by the comparator 321 is 1, the directivity selection unit 330 judges that the amount of motion is large, and outputs the signal input by the omnidirectional microphone 120.

As described above, judging motion according to a stricter condition when the motion is in a direction that is likely to generate noise and a looser condition when the motion is in a direction that is unlikely to generate noise enables continuously performing sensitive sound pickup with use of the directional microphone as much as possible, while reducing the influence of noise by switching to the omnidirectional microphone when the amount of motion is large.

Other Embodiments

Although several different combinations of means for detecting motion, means for judging the amount of motion, and means for controlling directivity are described above, other combinations thereof may also be used in the wearable terminal.

Also, although detecting the angular velocity with use of a gyroscope and analyzing a video taken by a camera are described as means of detecting motion, other methods, such as detecting motion with use of an acceleration sensor, may be used.

Furthermore, in directivity control, when the microphone switch signal SS1 has switched, auditory discomfort occurs if the directivity is switched instantaneously, and therefore switching may be performed with use of cross-fade processing. When switching from one directivity to another, cross-fade refers to gradually reducing the volume of the former while gradually increasing the volume of the latter.

Also, the directivity of the directional microphone is not limited to being unidirectional, and may have secondary sound pressure gradient type directivity, superdirectivity, etc.

INDUSTRIAL APPLICABILITY

A wearable terminal pertaining to the present invention detects motion thereof, uses a directional microphone when the amount of motion is small to enable sensitive sound pickup from a targeted direction, and uses an omnidirectional microphone when the amount of motion is large to enable continuing sound pickup by reducing motion-related noise and the influence of a shift of the pickup direction. According to this structure, the wearable terminal enables performing high-quality recording even in an unstable environment in which the user is continually wearing the wearable terminal and recording surrounding sounds. This type of microphone directivity control can be used not only in a wearable terminal, but also in a video camera, an audio recorder, a vehicle-mounted video/audio recording device, etc.

The invention claimed is:

1. A wearable terminal comprising:

a sound pickup unit operable to form a directivity having a predetermined directional pattern, and to pick up sound in accordance with the formed directivity;

a detection unit operable to detect motion of a wearable terminal housing; and a switching unit operable to, in accordance with an amount of detected motion of the wearable terminal housing, switch the directivity from the predetermined directional pattern to a different directional pattern or to an omnidirectional pattern, wherein the switching unit is configured to impose different conditions for the switching of the directivity depending on the direction of the detected motion.

2. The wearable terminal of claim 1, wherein the sound pickup unit includes a plurality of microphones, and the detected motion is motion that occurs in a reference axis direction of one of the microphones.

3. The wearable terminal of claim 2, wherein each of the microphones includes a diaphragm that senses sound pressure, the reference axis direction is an axial direction of the diaphragm when the diaphragm is considered to be substantially axially symmetric, and the motion detected by the detection unit is motion in a pitch direction and at least one other direction.

4. The wearable terminal of claim 3, wherein the switching unit includes a comparison subunit operable to compare an amount of the detected motion to a threshold, the switching unit is configured to switch the directivity when the amount of the detected motion of the wearable terminal housing exceeds the threshold, and the threshold is set at a smaller value for motion in a pitch direction than for motion in another direction.

5. The wearable terminal of claim 2, wherein the detection unit includes a sensor operable to output angular velocities of motion occurring in each of a pitch direction, a roll direction, and a yaw direction of the wearable terminal housing, and a converting subunit operable to select an angular velocity of motion that causes the one of the microphones to be displaced in the reference axis direction from among the angular velocities of motion occurring in the pitch direction, the roll direction, and the yaw direction, and to convert the selected angular velocity of motion into a displacement amount, and the switching unit includes a comparison subunit operable to compare the displacement amount to a threshold, and the switching unit is configured to switch the directivity when the displacement amount exceeds the threshold.

6. The wearable terminal of claim 5, wherein the comparison subunit varies the thresholds depending on a direction in which the motion has occurred.

7. The wearable terminal of claim 5, wherein when the displacement amount exceeds the threshold, the directivity of the sound pickup unit is switched to the omnidirectional pattern by the switching unit.

8. The wearable terminal of claim 7, further comprising:

a camera, wherein when the displacement amount is less than or equal to the threshold, the directivity of the sound pickup unit is switched by the switching unit to a pattern that has a peak in an image pickup direction of the camera.

9. The wearable terminal of claim 2, further comprising:

a camera operable to perform image processing at predetermined time intervals, wherein the detection unit is configured to detect the motion in the reference axis direction by comparing first and second images taken by the camera, the second image being taken by the camera before the first image is taken.

10. The wearable terminal of claim 9, wherein when a displacement amount of the wearable terminal housing in a pitch direction, which is determined based on the first and second images, exceeds a threshold, the directivity of the sound pickup unit is switched to an omnidirectional pattern by the switching unit.

11. The wearable terminal according to claim 1, wherein when a displacement amount in the reference axis direction is an output that has impulsivity, the directivity of the sound pickup unit is switched to an omnidirectional pattern by the switching unit.

12. The wearable terminal of claim 11, wherein the detection unit includes a sensor that outputs angular velocities of motion occurring in each of a pitch direction, a roll direction, and a yaw direction of the wearable terminal housing, the output that has impulsivity is expressed by a difference value between respective displacement amounts obtained from the angular velocities of motion occurring in two or more of the pitch direction, the roll direction, and the yaw direction, the switching unit includes a comparison subunit that compares the difference value to a threshold, and the switching unit is configured to switch the directivity when the difference value exceeds the threshold.

13. The wearable terminal of claim 11, further comprising:

a camera operable to perform image processing at predetermined time intervals, wherein the output that has impulsivity is expressed by an amount of shake in images taken by the camera.

14. The wearable terminal according to claim 11, wherein the sound pickup unit includes at least one each of a directional microphone and an omnidirectional microphone, and when motion is detected by the detection unit, the switching unit is configured to switch the directivity by switching an output signal from a signal received from the directional microphone to a signal received from the omnidirectional microphone.

15. The wearable terminal according to claim 11, wherein the sound pickup unit includes at least two omnidirectional microphones, the wearable terminal further comprises:

a synthesis unit operable to synthesize a signal representing the directivity from input signals generated by the omnidirectional microphones, and when motion is detected by the detection unit, the switching unit is is configured to switch an output signal from the signal synthesized by the synthesis unit to the input signals generated by the omnidirectional microphones.

16. The wearable terminal of claim 1, wherein the switching unit switches the directivity with use of cross-fade processing.

17. A processor for controlling a wearable terminal, the processor including an integrated circuit, wherein the wearable terminal includes a sound pickup unit operable to form a directivity having a predetermined directional pattern, and to pick up sound in accordance with the formed directivity, a detection unit operable to detect motion of a wearable terminal housing; and a switching unit operable to, in accordance with an amount of detected motion of the wearable terminal housing, switch the directivity from the predetermined directional pattern to a different directional pattern or to an omnidirectional pattern, wherein the integrated circuit is configured to outputs a signal for controlling the switching unit in accordance with a signal indicating a displacement amount of the motion of the wearable terminal housing detected by the detection unit, and the processor is configured to cause the switching unit to impose different conditions for the switching of the directivity depending on the direction of the detected motion.

18. A method for controlling a wearable terminal, comprising:

forming a directivity having a predetermined directional pattern, and picking up sound in accordance with the formed directivity;

detecting motion of a wearable terminal housing; and switching the directivity, in accordance with an amount of detected motion of the wearable terminal housing, from the predetermined directional pattern to a different directional pattern or to an omnidirectional pattern, wherein the switching comprises imposing different conditions for the switching of the directivity depending on the direction of the detected motion.

19. A program for causing a processor to perform control on a wearable terminal, the program comprising:

forming a directivity having a predetermined directional pattern, and picking up sound in accordance with the formed directivity;

detecting motion of a wearable terminal housing; and switching the directivity, in accordance with an amount of detected motion of the wearable terminal housing, from the predetermined directional pattern to a different directional pattern or to an omnidirectional pattern, wherein the switching comprises imposing different conditions for the switching of the directivity depending on the direction of the detected motion.

20. A computer-readable recording medium on which the program of claim 19 is recorded.

* * * * *

UNITED STATES PATENT AND TRADEMARK OFFICE

CERTIFICATE OF CORRECTION

PATENT NO. : 8,155,345 B2
APPLICATION NO. : 12/280842
DATED : April 10, 2012
INVENTOR(S) : Junichi Tagawa et al.

It is certified that error appears in the above-identified patent and that said Letters Patent is hereby corrected as shown below:

On the front page of the patent, item "(22) PCT Filed: Feb. 27, 2007" should read --(22) PCT Filed: Feb. 26, 2007--.

Signed and Sealed this
Eighteenth Day of September, 2012

David J. Kappos

David J. Kappos
*Director of the United States Patent and Trademark Office*